United States Patent [19]

Kawata et al.

[11] 4,357,513

[45] Nov. 2, 1982

[54] MICROWAVE OVEN WITH A VERTICALLY TRANSLATABLE RESISTANCE HEATER OR THE LIKE

[75] Inventors: Yukio Kawata; Tetsuo Obata; Chouji Keino; Isamu Tayama, all of Ojima, Japan

[73] Assignee: Mitsubishi Denki Kabushiki Kaisha, Tokyo, Japan

[21] Appl. No.: 173,902

[22] Filed: Jul. 30, 1980

[30] Foreign Application Priority Data

| | | | |
|---|---|---|---|
| Jul. 30, 1979 | [JP] | Japan | 54-97146 |
| Feb. 20, 1980 | [JP] | Japan | 55-20124 |
| Mar. 24, 1980 | [JP] | Japan | 55-38279 |
| Mar. 24, 1980 | [JP] | Japan | 55-38282 |

[51] Int. Cl.[3] ..... H05B 6/76

[52] U.S. Cl. ..... 219/10.55 B; 219/10.55 D; 219/10.55 E; 219/404

[58] Field of Search ..... 219/10.55 B, 10.55 D, 219/10.55 E, 10.55 F, 10.55 R, 404, 402, 403, 405, 409, 411, 413; 126/339, 337 A, 332

[56] References Cited

U.S. PATENT DOCUMENTS

| | | | |
|---|---|---|---|
| 3,196,243 | 7/1965 | Schall | 219/10.55 D |
| 3,241,543 | 3/1966 | Hirsch | 219/404 X |
| 3,281,575 | 10/1966 | Ferguson, Jr. | 219/404 |
| 4,137,442 | 1/1979 | Tateda | 219/10.55 B |
| 4,191,877 | 3/1980 | Tanaka et al. | 219/10.55 D X |

FOREIGN PATENT DOCUMENTS

| | | | |
|---|---|---|---|
| 43-29999 | 12/1968 | Japan | 219/10.55 D |
| 54-14038 | 2/1979 | Japan | 219/10.55 B |

*Primary Examiner*—B. A. Reynolds
*Assistant Examiner*—Philip H. Leung
*Attorney, Agent, or Firm*—Wenderoth, Lind & Ponack

[57] ABSTRACT

A microwave oven having a vertically translatable resistance heater disposed in the heating chamber thereof is disclosed. The two end portions of the heater extend from the interior of the heating chamber to the exterior thereof through a pair of parallel vertically elongated openings. The heater is vertically translated by a translation mechanism along the two elongated openings. The leakage of the electromagnetic waves through the elongated openings is prevented for the most part by annular choke chambers which are situated around the elongated openings and have communication ports which oppose the extending portions of the heater and through which electromagnetic waves leaking from the interior of the heating chamber through the elongated openings are introduced, thereby extinguishing the electromagnetic waves leaking through the elongated openings. Other auxiliary devices for preventing the leakage of the electromagnetic waves, such as absorbers, attenuators, or further choke chambers, may also be used together with the above noted choke chambers.

9 Claims, 22 Drawing Figures

MICROWAVE OVEN WITH A VERTICALLY TRANSLATABLE RESISTANCE HEATER OR THE LIKE

BACKGROUND OF THE INVENTION

This invention relates to microwave ovens, and especially to such ovens having vertically translatable members, such as resistance heaters, disposed in the heating room thereof.

It is often desirable that a member or members disposed in the heating chamber of microwave ovens and extending therefrom through an opening or openings into the exterior thereof be capable of vertical translation. For example, if the metal sheathed resistance heaters which are disposed in the heating chamber of microwave ovens and extend therefrom into the exterior thereof through the openings defined in the wall of the heating room can be translated vertically, control of the heating intensity to a finer degree becomes possible and higher heating efficiency can be achieved. In the case of conventional microwave ovens in which a rod-shaped heater having a terminal portion thereof extending from the heating chamber into the exterior thereof is rotated around said terminal portion, the rotational range of the heater has been limited. Thus, such conventional microwave ovens have been less than ideal for practical cooking purposes. The above-mentioned advantages resulting from vertically translatable heater may also result from vertically translatable reflectors, partition plates, or supporters for food containers disposed in the heating chamber of microwave ovens and supported by metal rods extending from the heating chamber to the exterior thereof through openings disposed in the walls of the heating chamber. Another case where vertical translation of a member which extends from the interior of the heating chamber of microwave ovens to the exterior thereof through an opening or openings is desirable is the case of temperature or humidity detectors for the foods to be heated which may be disposed in the heating chamber of microwave ovens for detecting to what degree the foods have been cooked. By making detectors capable of vertical translation, it becomes possible to place detector heads into the heated foods and to detect the temperature or the humidity of the foods without interrupting the heating operation, thereby realizing automatic control of the output power of a microwave oven.

In any of these cases, however, it has been practically impossible to make such members as described above vertically translatable, because, for vertical translation of the members disposed in the heating chamber of microwave ovens, one or a plurality of vertically elongated openings must be defined in the walls of the heating chamber through which said members extend from the interior of the heating chamber into the exterior thereof and along the longitudinal direction of which said members are translated vertically, and because there has been no method for preventing the leakage of electromagnetic waves through such elongated openings with practical effectiveness and reliability. This leakage of electromagnetic waves is especially serious because the members extending from the interior of the heating chamber of microwave ovens to the exterior thereof are formed of metal, and such metal members function as antennas which receive and lead out the electromagnetic waves filling the heating chamber of microwave ovens.

SUMMARY OF THE INVENTION

Therefore, it is an object of the present invention to provide a high frequency heating apparatus which has disposed in the heating chamber thereof a vertically translatable member or member while effectively and reliably eliminating the danger of electromagnetic wave leakage from the heating chamber thereof into the exterior space.

Another object of the present invention is to provide a high frequency heating apparatus of the above mentioned kind which is easy to maintain and has greater durability.

Still another object of the present invention is to provide a high frequency heating apparatus of the above mentioned kind which is capable of controlling the heating intensity thereof to a finer degree than has hitherto been possible while attaining higher heating efficiency than has hitherto been attained.

A further object of the present invention is to provide a high frequency heating apparatus of the above mentioned kind which is capable of electronically detecting how well the food which is being heated by said heating apparatus has been cooked so that an automatic control of the output power of said high frequency heating apparatus can be realized.

A still further object of the present invention is to provide a high frequency heating apparatus of the above mentioned kind in which the vertically translatable member can be translated smoothly along a constant path without accidental deviations therefrom.

The present invention provides a high frequency heating apparatus which comprises an enclosure enclosing a heating chamber, a supply means supplying electromagnetic waves into said heating chamber, a member extending from the interior of said heating chamber into the exterior thereof through at least one elongated opening defined in a wall of said enclosure, translation means for translating said extending member in the longitudinal direction of said elongated opening, and leakage preventing means for preventing the leakage of electromagnetic waves from the interior of said heating chamber into the exterior thereof through said elongated opening.

Said leakage preventing means comprises at least one first choking space situated on that portion of the exterior surface of said wall of the enclosure which surrounds the periphery of said elongated opening. Said first space has a communication port which opposes said extending member and through which the electromagnetic waves are introduced into said first space from the interior of said heating chamber through said elongated openings, thereby extinguishing, by the choke effect, the electromagnetic waves leaking from the interior of said heating chamber through said elongated openings.

Preferably, the longitudinal length of the elongated opening is substantially equal to an odd multiple of a quarter of the fundamental wave-length of the electromagnetic waves.

In one aspect of the present invention, the first space is stationary with respect to the enclosure and is defined by walls which are fixed to said wall of the enclosure defining the elongated opening, and preferably the communication port of the first space is hermetically sealed by a cover which is formed of a refractory material having a low coefficient of friction and which has a pair of projections which are in contact with or closely adjacent to said extending member during the translation of said extending member.

In another aspect of the present invention, the first space is vertically translatable, and the outer side walls and the back wall partly defining the first space are vertically translated with said extending member by the translation mechanism. In this aspect of the present invention, attenuator plates for attenuating the electromagnetic waves propagating in the longitudinal direction of the elongated openings may be disposed in the first space parallel to the back wall of the first space, or outside the first space parallel to the side walls of the first space.

In both aspects of the present invention, at least one further space having a communication port situated at the path of the electromagnetic waves leaking from said first space, and/or at least one absorber situated at the path of electromagnetic waves leaking from said space may be disposed. Said further space extinguishes by the choke effect, said electromagnetic waves leaking from said first space, and said absorber absorbes and dissipates the energy of said electromagnetic waves leaking from said first space.

Preferably, the translation mechanism comprises stopper means which stops and holds the extending member at a plurality of positions which are spaced from each other by a predetermined distance substantially equal to a quarter of the fundamental wave-length of the electromagnetic waves.

The extending member may be one of the following:

(1) a resistance heater disposed in the heating chamber, (2) a wire connecting said resistance heater to a power source, (3) a detector disposed in said heating chamber and detecting the temperature or the humidity of the food to be heated, (4) a wire connecting said detector to a power source, (5) a rod for supporting a reflector plate disposed in the heating chamber, (6) a rod for supporting a supporter for the container of food, which is disposed in the heating chamber, or (7) a rod for supporting a partition plate disposed in said heating chamber and partitioning said chamber into a plurality of portions thereof.

BRIEF DESCRIPTION OF THE DRAWINGS

Further objects and advantages, or principles of the present invention will become more apparent from the following detailed description of the preferred embodiments of the present invention made in conjunction with the drawings, in which.

In the drawings, like reference numerals or characters designate like or corresponding parts or dimensions.

DESCRIPTION OF THE PREFERRED EMBODIMENTS

Figure 1:
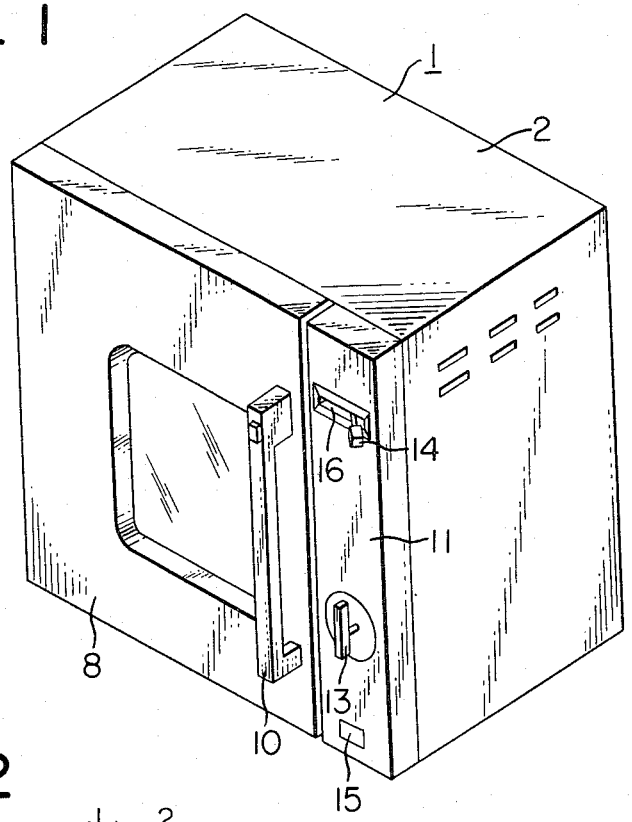
FIG. 1 is a perspective view of a microwave oven according to the present invention, showing the outward appearance thereof.
Figure 2:
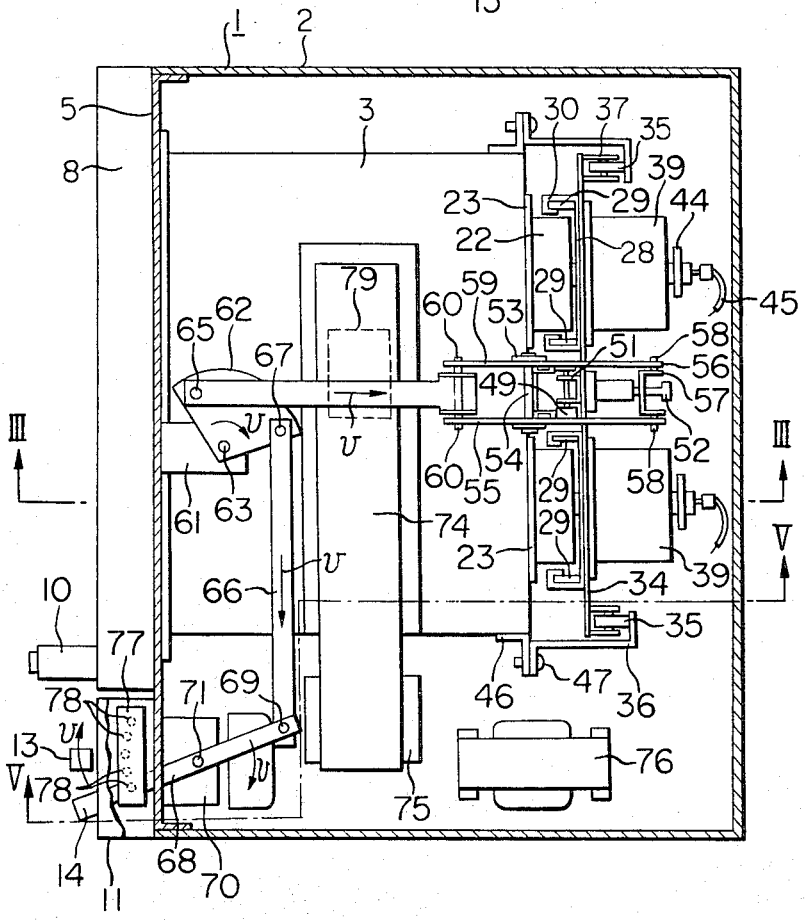
FIG. 2 is a cutaway top view of the microwave oven of FIG. 1, showing the microwave oven with the upper wall of the outer housing cut away, as viewed from the top.

Referring now to FIGS. 1 through 7, a microwave oven according to the present invention having a rod-shaped resistance heater which extends from the heating chamber thereof to the exterior thereof and which is capable of being vertically translated will now be described.

The microwave oven comprises a main body 1, a metal outer housing 2 forming the outer shell of the main body 1, a heating box 3 forming a heating chamber 4 therein, a metal front plate 5 which is fixed to the front peripheries of the heating box 3 and the metal outer housing 2 and has defined therein a front aperture 6 forming a window 7, and a door 8 which is capable of closing and opening the front aperture 6 of the heating chamber 4, and is rotatably mounted to the main body 1 through a shaft 9.

The microwave oven also comprises a door handle 10 attached to the door 8, an operator's panel 11, a guide port 16 defined in the operator's panel 11 and guiding a knob 14 for the translation of a sheathed resistance heater 19 which is described later. The operator's panel 11 has disposed thereon a knob 13 of a timer 12 which controls the microwave heating time and the resistance heater heating time, and an operation button 15 by which a switch (not shown) commanding the initiation of heating can be operated. In the heating chamber 4, a supporter 17 for a food container may be disposed when necessary. A pair of vertically elongated openings 18 are defined in the back wall of the heating box 3 in the vertical direction with respect to the microwave oven which is set in the proper position thereof. As is shown in detail in FIG. 7, the elongated openings 18 have a width A of 10 mm and length B in the vertical direction of 153 mm which is substantially equal to 5 times a quarter of the fundamental wave-length of the electromagnetic waves utilized in the microwave oven, namely 30.6 mm, since the fundamental frequency of electromagnetic waves utilized in the microwave oven is substantially equal to 2450 MHz. This length B was chosen because as a result of repeated experiments, it was found that when the length B of the elongated openings 18 is an odd multiple (namely 3 times, 5 times, 7 times, and so on) of a quarter of the fundamental wave-length of the electromagnetic waves filling the interior of the heating chamber 4, the amount of the electromagnetic waves leaking or escaping from the interior of the heating room 4 through the elongated openings 18 is minimized. Of course, other lengths of the elongated openings equal to, for example, 3 or 7 times a quarter of the fundamental wave-length of the electromagnetic waves utilized in the microwave oven may equally be chosen if such dimensions are preferable.

In the heating chamber 4 of the microwave oven are disposed two resistance heaters 19 and 20 sheathed in hollow metal cylinders of a diameter C of about 7 mm. Both ends of the heater 19 extend to the exterior of the heating chamber 4 through said openings 18. The end portions of the lower heater 20 also extend to the exterior of the heating chamber 4 through the back wall of the heating box 3.

Figure 7:
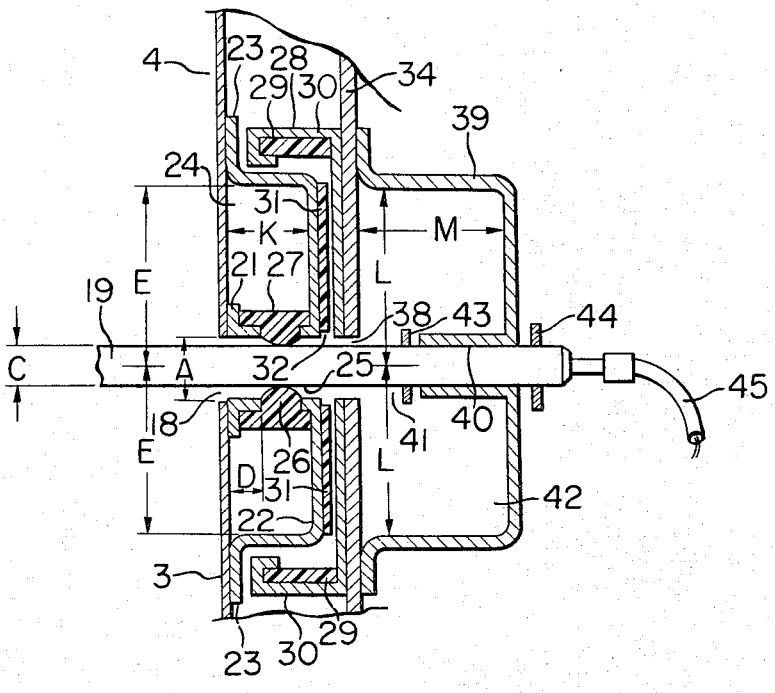
FIG. 7 is a partial horizontal sectional view of the portion near one of the pair of end portions of the upper heater disposed in the heating chamber of the microwave oven of FIG. 1, showing an enlarged cross section of the portion enclosed by line P of FIG. 4.

A pair of partition plates 21 forming a pair of hollow oblong cylinders with base lines coinciding with the peripheries of said pair of elongated openings 18 are fixed, through a pair of flanges thereof projecting outwardly from the front bases of said cylinders, to the annular portions of the exterior surface of the back wall of the heating box 3, which surround said peripheries. As shown in FIG. 7, the depth D of the partition plates 21 or the height in the axial direction of said cylinders is designed to be equal to about 7 to 8 mm. Thus the cylindrical portions of said partition plates 21 surround both end portions of said upper heater 19.

A pair of metal shield plates 22 having the form of oblong cylinders with open front bases have flanges 23 projecting outwardly from the front bases of the cylindrical portions of the metal shield plates 22. The metal shield plates 22 are formed by a press machine from a single sheet of metal, and the flanges 23 are spot welded to the heating box 4.

Said pair of partition plates 21 and said pair of shield plates 22 together with the peripheral annular portions of the exterior surface of the back wall of the heating box 3 enclose a pair of first choke chambers or first electromagnetic wave leakage preventing chambers 24. A widthwise depth E of the chambers 24 measured from the central points thereof along the direction of width of said chambers 24 is substantially equal to a quarter of the fundamental wavelength of the electromagnetic waves utilized in the microwave oven, and a height G of the chambers 24 in the vertical direction of the microwave oven measured from the peripheries of a pair of elongated openings 25 defined in the back walls of the shield plates 22 is equal to about 27 mm which is about 3 mm shorter than a quarter of said fundamental wavelength. Said elongated openings 25 defined in the shield plates 22 have a length F equal to about 130 mm.

The upper heater 19 can be vertically translated along a vertical length H of about 123 mm by a translation mechanism which will be described hereinafter, and can be stopped and held only at positions which are spaced from each other by an interval J which is substantially equal to a quarter of said fundamental wavelength. Therefore, the upper heater 19 can be stopped and held at five different positions or heights. A depth K of the chambers 24 is equal to 15 mm which is substantially equal to one eighth of said fundamental wavelength. A pair of communication ports 26 for the pair of leakage preventing chambers 24 is defined by the metal partition plates 21 and the metal shield plates 22, and are hermetically sealed by covers 27 which are inserted in the interiors of the shield plates 22 in advance around the elongated openings 25. The covers 27 are formed of a refractory material having a high transmissivity to electromagnetic waves and a low coefficient of friction, such as polytetrafluoroethylene, as integral unitary structures, and have substantially the form of oblong rings or cylinders with circumferencially extending interior projections which come in contact with the end portions of the upper heater 19.

Each of a pair of metal translating plates 28 has a pair of end portions 30 bent to the back wall of the heating chamber 4 to surround the sides of each of the shield plates 22, and is of sufficient dimensions to cover the elongated opening 25 of each of the shield plates 22 at any position thereof along the translation path.

A pair of electromagnetic wave absorbing members 29 are held by said pair of bent end portions 30 of each of the translating plates 28. The absorbing members 29 are formed of a material having a certain degree of conductance to allow some current to flow therethrough when placed in an electromagnetic field, thereby dissipating the energy of the electromagnetic field. An example of such a material of which the absorbing members 29 can be formed is a plastic material composed of ferrite dust with a polyethylene binder. The absorbing members 29 are disposed along the whole vertical lengths of the end portions 30 of the pair of translating plates 28.

A pair of spacers 31 in the form of annular plates interposed between the translating plates 28 and the shield plates 22 are formed of a material such as refractory synthetic resin having a low coefficient of friction and are fixed to the back surfaces of the pair of shield plates 22. A pair of longated openings 32 are defined along the central lines of the spacers 31 to have a length and a width which substantially coincide with those of the elongated openings 25 defined in the pair of shield plates 22 so that the elongated openings 32 defined in the spacers and the elongated openings 25 defined in the shield plates 22 come to be substantially in registry with each other. Circular openings 33 are defined in the translating plates 28 to allow the end portions of the upper heater 19 to extend therethrough.

A metal supporter plate 34 fixed to the pair of translating plates 28 to bridge the translating plates 28 has on both sides thereof two pairs of rollers 35 formed of refractory synthetic resin and held by holders 37 so that the supporter plate 34 is capable of being translated in the vertical direction with respect to the main body 1 set in the proper position thereof, with the rollers 35 being guided along a pair of rails 36 fixed by screws 47 to supporters 46 which are fixed in their turn to the exterior surface of the heating box 3.

Two circular openings 38 defined in the supporter plate 34 to be in registry with the circular openings 33 defined in the translatings plates 28 are covered by a pair of metal casings 39 in the form of hollow circular cylinders with open front bases and closed back bases. The flanges projecting from the front bases of cylindrical portions of the casings 39 are spot welded to the back surface of the supporter plate 34. The cylindrical portions of the casings 39 have inner radius L and inner depth M substantially equal to a quarter of said fundamental wave-length, and the back base portions of the casings 39 have defined at the central portion thereof a pair of circular openings 40 through which the ends of the upper heaters 19 tightly extend. Thus, a pair of second electromagnetic wave leakage preventing chambers 42 are formed between the supporter plate 34 and the pair of casings 39. The communication ports 41 thereof through which electromagnetic waves may be introduced into the second leakage preventing chambers 42 are situated arround the end portions of the upper heater 19. A pair of stopper rings 43 fixed in advance to both end portions of the upper heater 19, for example by welding, and a pair of fixer rings 44 formed of a resilient material and disengageably engaging with the ends of the upper heater 19 extending from the back surfaces of the casings 39, fix the upper heater 19 to the casings 39. A pair of lines 45 connect the ends of the upper heater 19 to a power source (not shown).

A metal plate 48 with a U-shaped horizontal cross section fixed to the back wall of the heating box 3 along the central vertical line of said back wall has both sides thereof bent in the lateral direction to form bent portions having an L-shaped horizontal cross section. Said bent portions of the metal plate 48 function as guide rails for the rollers 49 supported by the supporter plate 34, and have fixed on the surface thereof opposing the shield plates 22 a pair of electromagnetic wave absorbing members 50 in the form of elongated plates. The absorbing members 50 may be formed of a plastic material composed of fine particles of a ferrite material with a polyethylene binder, like the absorbing members 29 disposed on the bent portions 30 of translating plates 28. The rollers 49 are held by the roller holders 51.

A fixer pin 52 fixed to a central portion of the supporter plate 34 fixes the first lever 57 to the supporter plate 34. A first pin holder 53 fixed to the upper wall of the heating box 3 holds a pin 54 by which a pair of V-shaped connector rods 55 are rotatably supported. The arms 56 thereof extending in the backward direction hold a pair of pins 58 which rotatably support the first lever 57 at one end thereof, the other end of the first lever 57 being engaged with said fixer pin 52. The other arms 59 of the connector rods 55 extending to the forward direction are rotatably connected to one end of a second lever 64 through a pin 60.

A supporter plate 61 fixed to the front plate 5 rotatably supports an interlocking plate 62 through a pin 63, and the other end of the second lever 64 is rotatably connected to one end of the interlocking plate 62 through a pin 65.

A third lever 66 is rotatably fixed to the other end of the interlocking plate 62 at one end thereof through a pin 67, and an operation lever 68 which is rotatably fixed to the other end of the third lever through a pin 69 at one end thereof rotates around the pin 71 held by another pin holder 70 fixed to the front plate 5. The other end of the operation lever 68 projects from the guide port 16 defined in the operator's panel 11.

Figure 3:
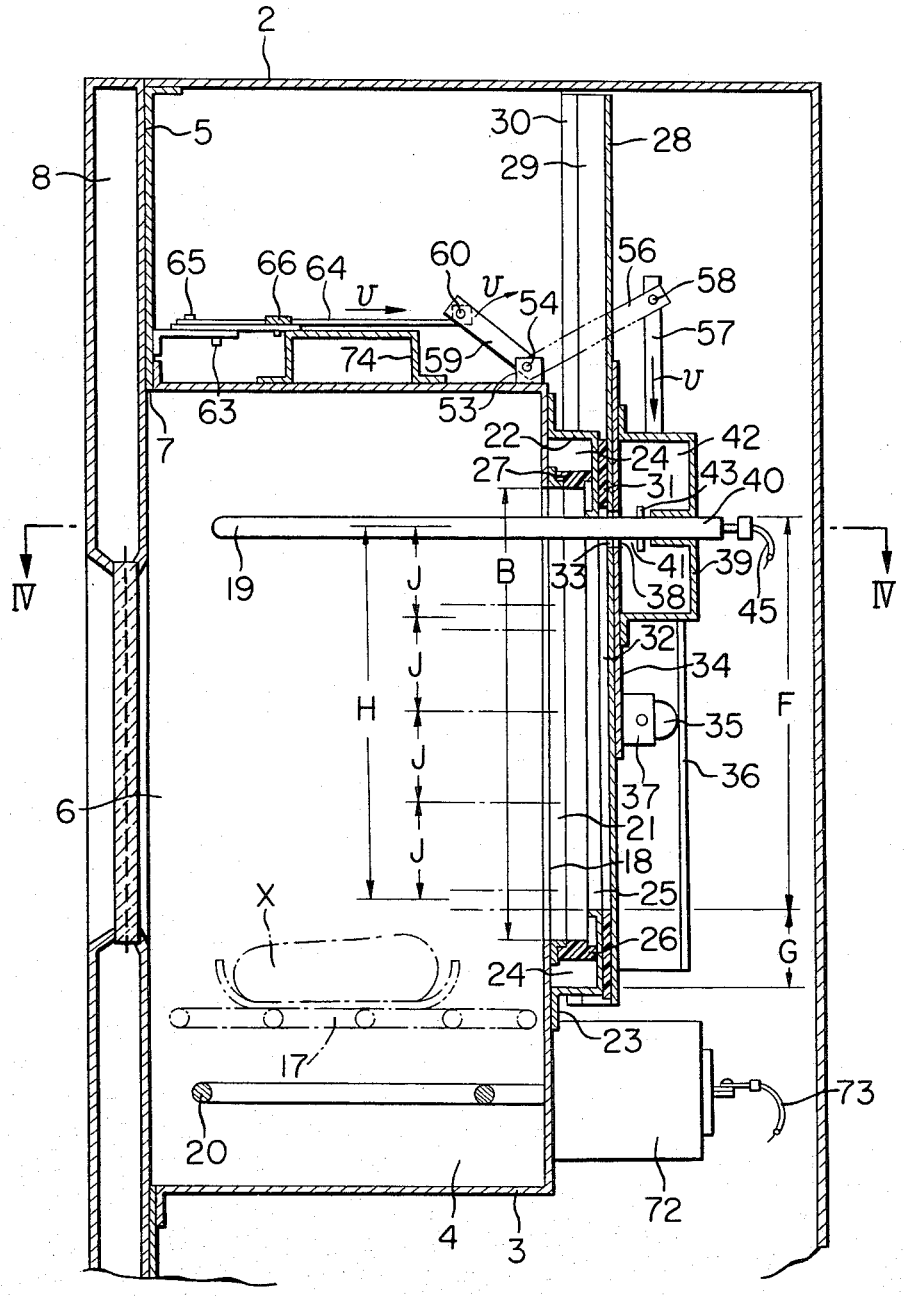
FIG. 3 is a sectional side view of the microwave oven of FIG. 1, showing a vertical cross section of the microwave oven taken along the line III—III of FIG. 2.
Figure 4:
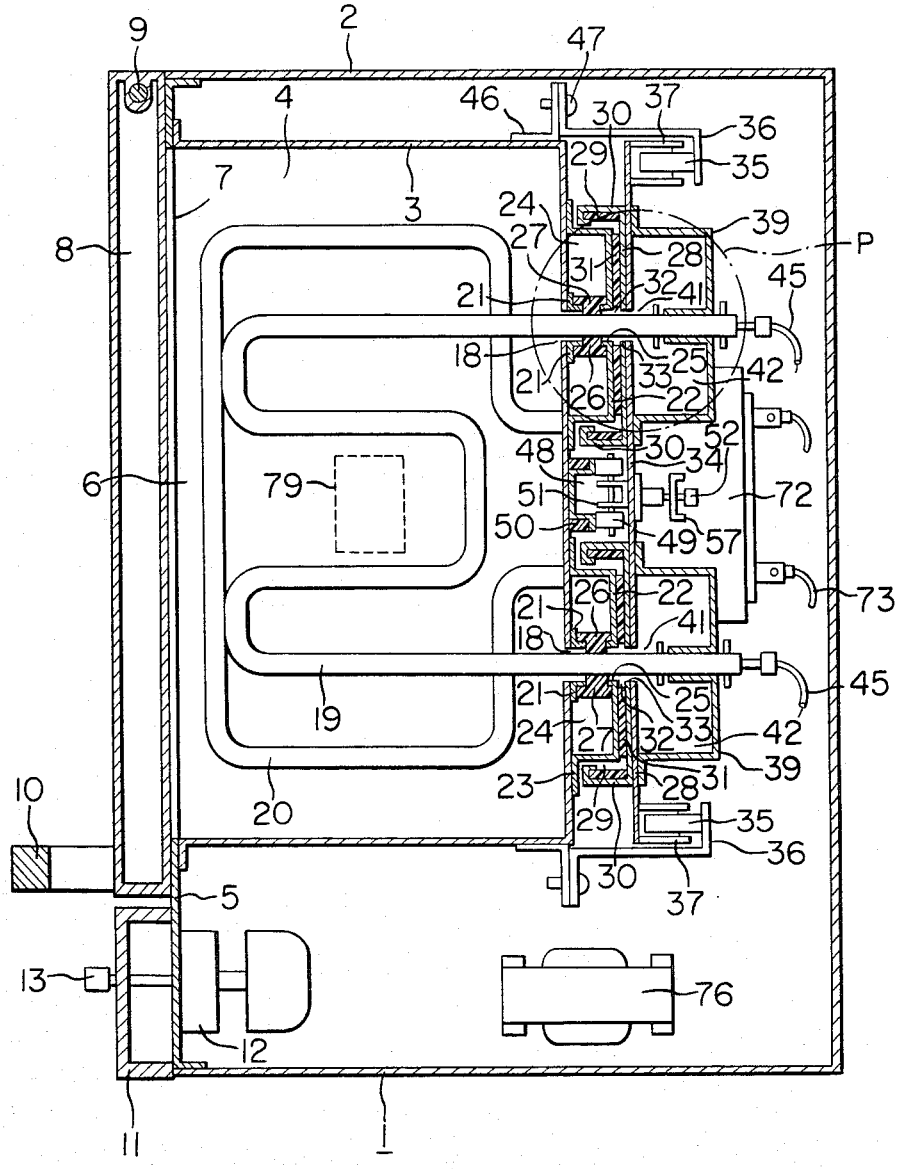
FIG. 4 is a sectional plan view of the microwave oven of FIG. 1, showing a horizontal cross section of the microwave oven taken along the line IV—IV of FIG. 3.
Figure 5:
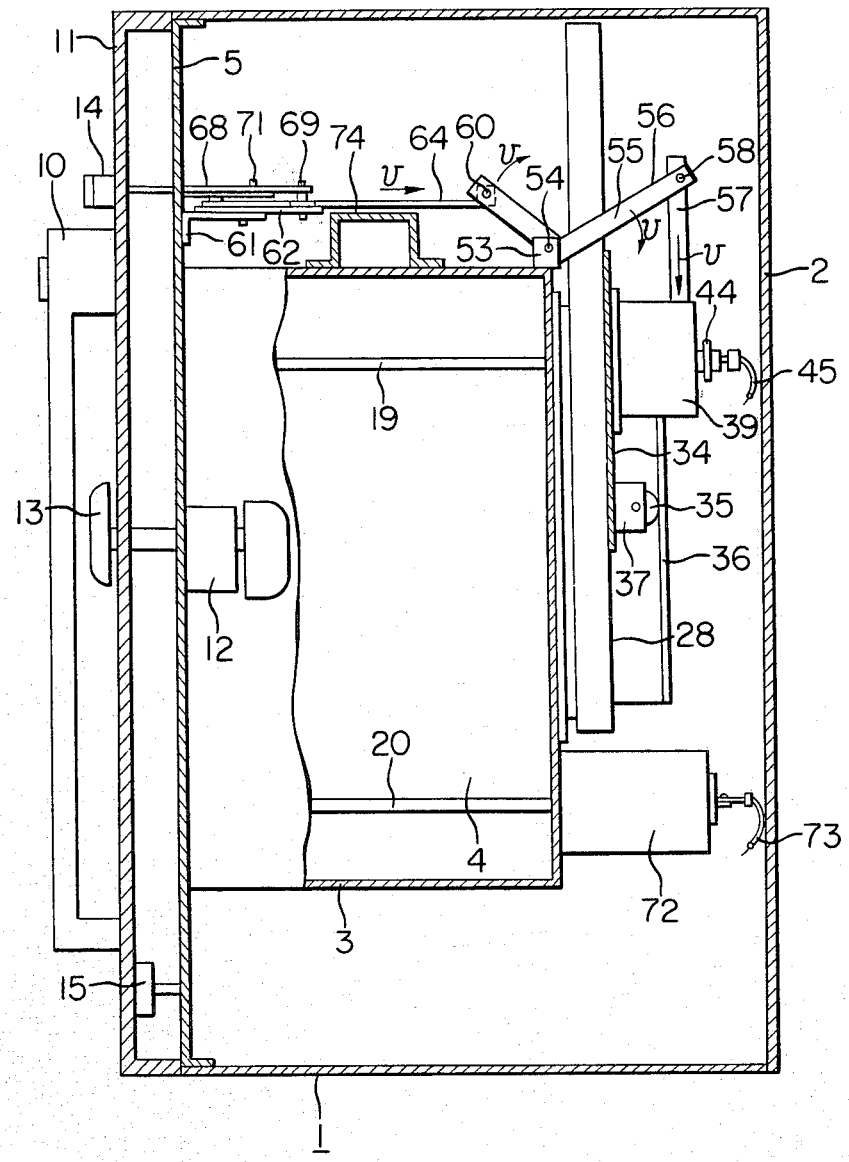
FIG. 5 is a cross-sectional side view of the microwave oven of FIG. 1, showing a vertical cross section of the microwave oven taken along the line V—V of FIG. 2.
Figure 6:
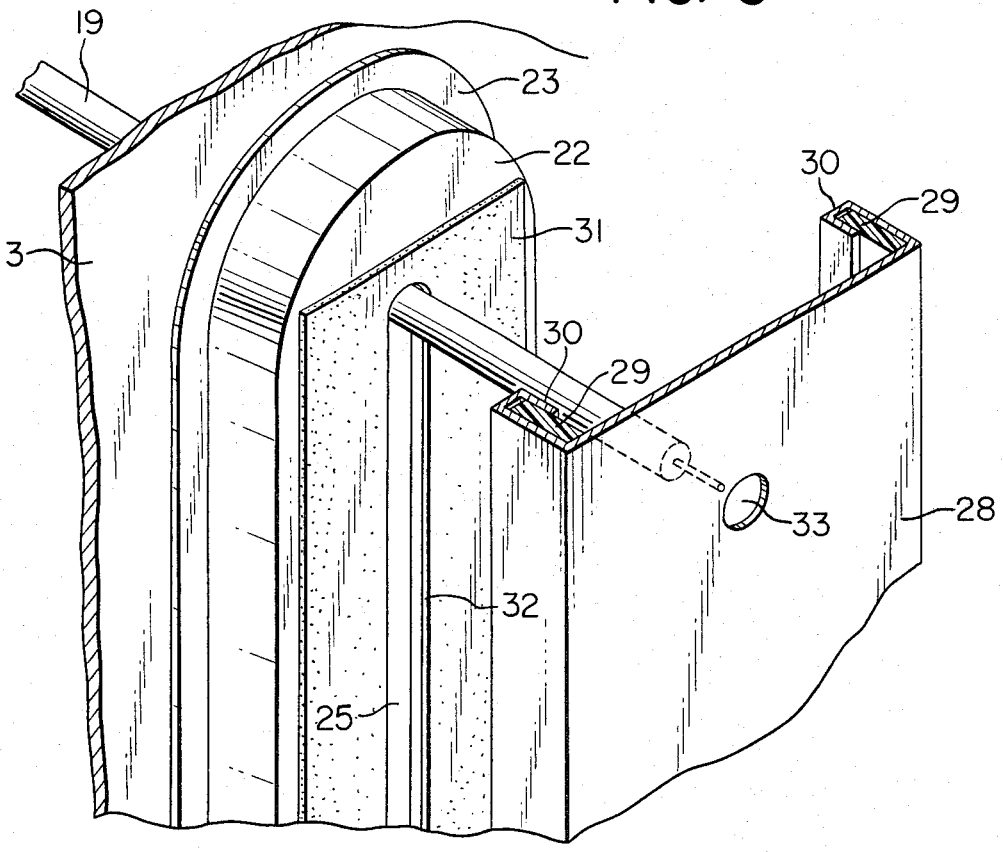
FIG. 6 is a fragmental perspective view of a portion near one of a pair of the end portions of an upper heater disposed in the heating chamber of the microwave oven of FIG. 1, showing the outward appearance of one of the pair of the leakage preventing chambers with the translating plate partially cut away along a horizontal line and removed halfway from said one of the pair of the leakage preventing chambers.

The operation lever 68 extends between the upper and lower plates of a stopper 77 to be sandwiched by said plates of the stopper 77 which guide the operation lever 68. Five recesses 78 are defined at equiangular intervals in the surface of the lower plate of the stopper 77 which opposes the operation lever 68. The recesses 78 are capable of engaging with a projection formed on the lower surface of the operation lever 68 so that the lever 68 can be stopped and held at five different positions, thereby allowing the upper heater 19 to be stopped and held at five different positions along the translation length H, which are spaced from each other by an interval substantially equal to a quarter of the fundamental wave-length, as shown in FIG. 3.

A metal socket 72 disposed around the end portions of the lower heater 20 extending into the exterior of the heating box 3 prevents the leakage of electromagnetic waves therefrom. A line 73 connects the lower heater 20 to the power source (not shown).

A magnetron oscillator 75 generates the electromagnetic waves having a frequency suitable for the dielectric heating of food X, which is substantially equal to 2450 MHz, and the generated electromagnetic waves are introduced into the heating chamber from a port 79 defined in the central portion of the upper wall of the heating box 3 via a wave guide 74 which connects said magnetron oscillator 75 to said port 79. A transformer 76 supplies high voltage power to the magnetron oscillator 75. Food X with a container thereof may be placed on the supporter 17.

The operation of the apparatus as hereinabove described is now explained.

When the knob 14 on the operator's panel 11 is moved by an operator in the direction of the arrow v, this movement is transmitted through the third lever 66 to the interlocking plate 62, and further to the connecting rods 55 through the second lever 64 as is shown by the arrows v. The length of movement of the knob 14 at the end of the operation lever 68 is magnified by a certain ratio by said V-shaped connecting rods 55, said ratio being determined by the ratio of the lengths of the arms 56 and 59 of the connecting rods 55. Thus, the supporter plate 34 and the pair of translating plates 28 together with the upper heater 19 are translated vertically downwards in the direction of the arrow v by an amount which is equal to said length of movement of the knob 14 multiplied by said ratio, the supporter plate 34 being guided by the pair of guide rail 36 and the metal plate 48 via the rollers 35 and 49.

As the operating lever 68 can be stopped and held by the stopper 77 at five predetermined positions along the path of movement thereof, the supporter plate 34 can also be stopped and held at the positions corresponding to said five predetermined positions. Thus, as described hereinbefore, the heater 19 can be stopped at one of five positions which are separated from each other by an equal distance J which is substantially equal to a quarter of the fundamental wavelength of the electromagnetic waves utilized in the microwave range, that is to say, the electromagnetic waves generated by said magnetron oscillator 75. When current is supplied to the upper and lower heaters 19 and 20 with the upper heater 19 stopped and held at one of said positions, the food or the article to be heated X can be cooked in a short time by the heat received from the upper and lower heaters 19 and 20.

When the magnetron oscillator 75 is driven to generate electromagnetic waves having a fundamental frequency substantially equal to 2450 MHz, with the upper and lower heaters 19 and 20 in this state, the electromagnetic waves thus generated are introduced into the heating chamber 4 from the port 79 through the wave guide 74 connecting the magnetron oscillator 75 with the port 79, and thus the food X contained in the container placed on the supporter 17 is also heated from within by dielectric heating and is cooked very quickly.

During the time when the magnetron oscillator 75 is operated, the electromagnetic waves generated by the magnetron 75 and introduced into the heating chamber 4 tend to leak or escape to the exterior of the heating chamber 4 through the pair of elongated openings 18 defined in the back wall of the heating box 3. But, because the vertical length B of the pair of parallel openings is substantially equal to five times a quarter of the fundamental wave length of said electromagnetic waves, the electromagnetic waves are effectively prevented from escaping therethrough.

As described hereinabove, it has been found by a series of experiments that the amount of leaking electromagnetic waves can be minimized by designing the length of the elongated openings to be substantially equal to an odd multiple, e.g. 3, 5, 7, and so on, of a quarter of the fundamental wave-length of said electromagnetic waves. Conversely, the amount of leaking electromagnetic waves was found to become greater when the length B of the elongated openings is set to be equal to an even multiple, e.g. 2, 4, 6, and so on, of a quarter of the fundamental wave length of said electromagnetic waves. These experimental results can be explained by the theory that length B of the elongated openings 18 equal to an even multiple of said quarter of the fundamental wave-length gives rise to a resonance of electromagnetic waves at the elongated openings 18, as it does in the case of wave guides, while a length B equal to an odd multiple of a quarter of said fundamental wave-length occasions an anti-resonance phenomenon, or the mutual cancellation of the electromagnetic waves by reflections of the electromagnetic waves, thereby reducing the amount of electromagnetic waves escaping from the openings 18. If the vertical length F of the pair of elongated openings 25 is set to be equal to the length B of the elongated openings 18, the conditions for the anti-resonance phenomenon is satisfied at the elongated openings 25, but then the function of the back walls of the shield plates of introducing into the first leakage preventing chambers the electromagnetic waves which tend to escape into the exterior of the heating chamber 4 through the elongated openings 18 and 25 is reduced, thereby allowing a greater amount of the electromagnetic waves to leak from the elongated openings 25.

By designing the length and positions of the elongated openings 18 and 25 together with the geometry of the first leakage preventing chambers as hereinbefore described, the leakage of the electromagnetic waves through the elongated openings 18 and 25 is prevented firstly by the fact that the amount of the electromagnetic waves passing through the openings 18 is limited by said anti-resonance phenomenon, and secondly by the fact that the electromagnetic waves which have passed through the openings 18 are introduced into the first leakage preventing chambers 24 via the communication ports 26 and are prevented from leaking into the elongated openings 25 by the choke effect, that is to say, by the phenomenon that the electromagnetic waves are mutually cancelled by the reflections thereof. The leakage preventing capability of the arrangements as hereinabove described is enhanced by the fact that the length F of the elongated openings 25 deviates from an even multiple of a quarter of said fundamental wave-length, and thus the openings 25 themselves have the function of preventing the leakage of electromagnetic waves.

The small amount of electromagnetic waves escaping from the elongated openings 25 defined in the shield plates 22 is either introduced into the second leakage preventing chambers 42 through the circular openings 33 and 38 which are defined in the translating plates 28 and the supporter plate 34 respectively, thereby cancelling each other at the communication ports 41 by the choke effect, or they are absorbed by the absorbing members 29 and 50 which are disposed at right angles to the direction of leakage of the electromagnetic waves which tend to escape to the exterior through the narrow gaps formed between the shield plates 22 and the translating plates 28.

As described hereinabove, it can be ensured that the electromagnetic waves which tend to escape into the exterior of the heating chamber 4 through the elongated openings 18 are either extinguished by the choke effect or absorbed, thereby preventing the electronic components included in the main body 1 from being adversely affected and prevented from proper functioning by the electromagnetic noise created by the leaking electromagnetic waves, and also ensuring that any human beings near the microwave oven do not suffer any harmful effects from electromagnetic waves leaking from the range.

The covers 27, which hermetically seal the communication ports 26 of the first leakage preventing chambers 24, prevent the vapors or impurities arising from the food X and the heat developed by the heaters 19 and 20 from entering into the first leakage preventing chambers 24, and thus ensures that the shield plates 22 are kept at a low temperature. Therefore, the absorber members 29 can be prevented from being adversely affected by high temperature. In addition, the spacers 31 interposed between the shield plates 22 and the translating plates 28 effectively block the transfer of heat from the shield plates 22 to the translating plates 28.

Because the portions of covers 27 which cover the vertical lengths of the elongated ports 18, at least, have projections which are in contact with the end portions of the upper heater 19, and the end portions of the upper heater 19 are continuously held between said projections is close contact therewith, the upper heater 19 can be kept at a position thereof with certainty, and thus the distances between the end portions of the upper heater 19 and the side walls of the first leakage preventing chambers 24 can be kept constant. Therefore, the leakage of electromagnetic waves is prevented stably and effectively. A further advantage of the disposition of the covers 27 is that the translation of the upper heater 19 can be effected by an operator without exertion because the upper heater 19 is guided smoothly by the projections of the covers 27 without meeting any obstruction.

Further embodiments of the present invention, which are described in the following descriptions, are similar in structure and operation to the first embodiment of FIGS. 1 to 7, except for some additional features and modifications of the structures of the portions including the first leakage preventing chambers. The details of the structures and the operations of the embodiments which are similar to those of the first embodiment are omitted from the following descriptions and drawings thereof. For such details, refer to the descriptions and drawings of the first embodiment. In particular the translation mechanism and the magnetron oscillator of the following embodiments is completely omitted from the drawings thereof.

Figure 8:
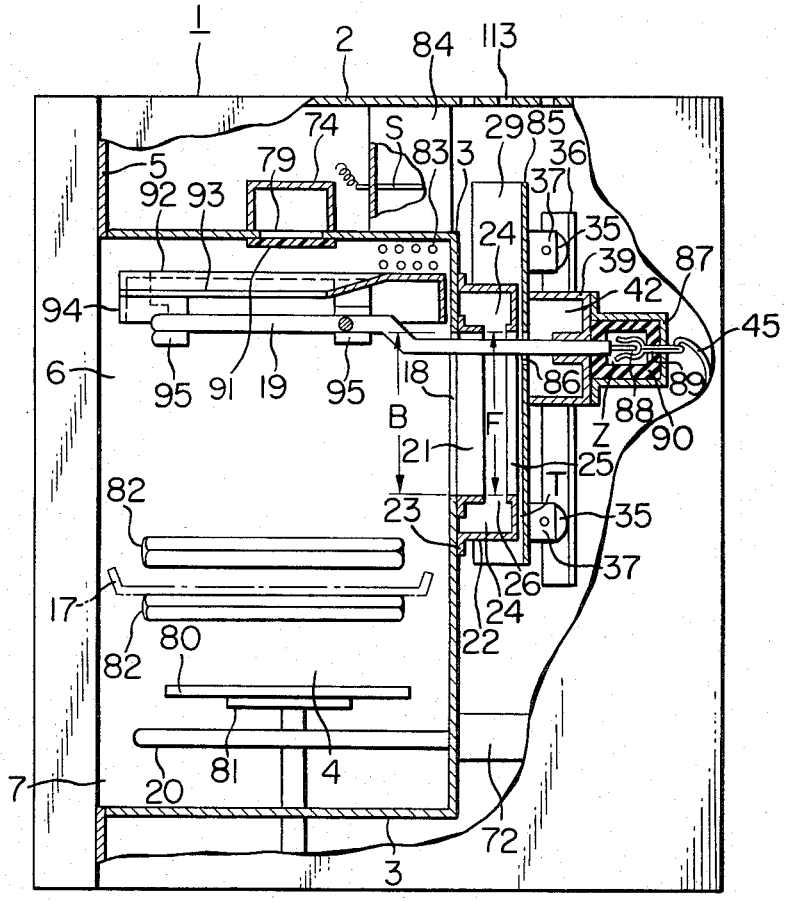
FIG. 8 is a fragmental sectional side view of a second microwave oven according to the present invention, showing a fragmental side cross section thereof.
Figure 9:
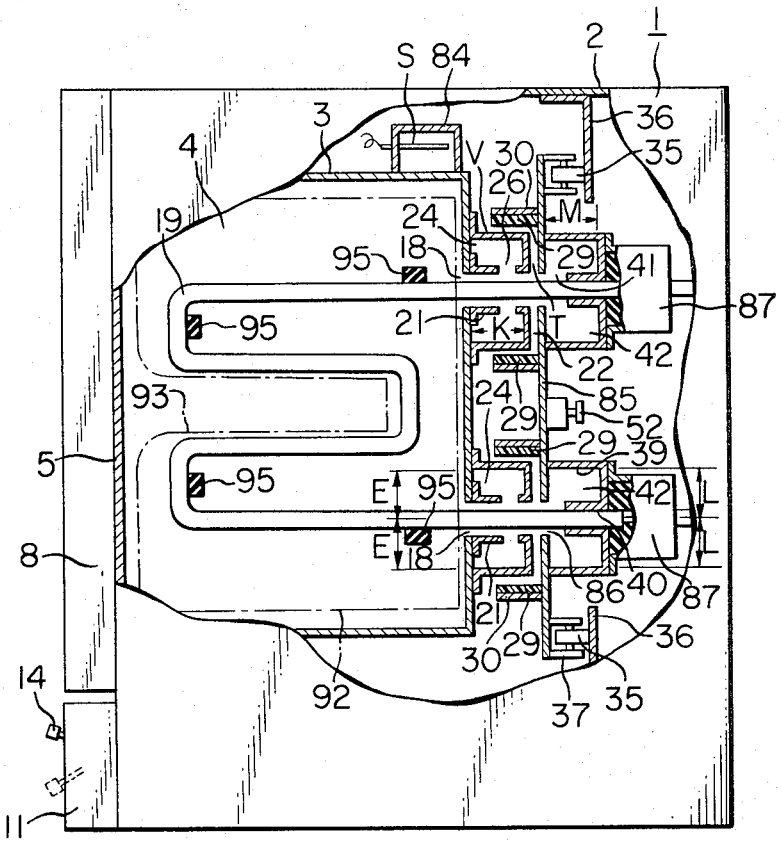
FIG. 9 is a fragmental sectional top view of the microwave oven of FIG. 8, showing a fragmental horizontal cross section thereof.

Referring now to FIGS. 8 and 9, a second embodiment of the present invention is described.

A metal rotatable table 80 on which an article to be heated or food with a container may be placed can be superposed on a driving disk 81 which is disposed in the lower portion of the heating room 4 and is driven by an electric motor (not shown) disposed outside of the heating chamber 4. Two pairs of horizontal projections 82 are integrally formed on the inner surfaces of the side walls of the heating box 3. A supporter 17 for a container of food which, in this embodiment, has the form of a rectangular saucer, may be inserted between said pairs of projections 82 when desired. A pair of elongated openings 18 have a vertical length B substantially equal to three times a quarter of the fundamental wave-length of the electromagnetic wave utilized in the microwave oven.

A plurality of ports 83 are defined in an upper portion of one of the side walls of the heating box 3, and an exhaust duct 84 is connected therewith at one end thereof, the other end thereof communicating with the exterior of the outer housing 2. A temperature sensor S of a temperature controller of the variable operation temperature type (not shown) which detects the temperature of the exhaust air in the duct 84 and controls the supply of power to the heaters 19 and 20, thereby keeping the temperature within the heating chamber 4 at a desired predetermined temperature, is disposed in the interior of said duct 84. A plurality of ports 113 for exhausting hot air filling the interior of the outer housing 2 are defined in the upper wall of the outer housing 2.

A width wise depth E of the first chambers 24 measured from the central points thereof along the direction of width of the chambers 24 and a depth K of the first chambers 24 is substantially equal to a quarter of the fundamental wave-length. A length F of the elongated openings 25 defined in the shield plates 22 in this embodiment is designed to be equal to the length B of the elongated openings 18 defined in the back wall of the heating box 3, that is to say, substantially equal to three times a quarter of said fundamental wave-length. The communication ports 26 of the first leakage preventing chambers 24, which are not covered in this second embodiment, may also be hermetically sealed by covers corresponding to the covers 27 disposed in the first embodiment. A single translating supporter plate 85 corresponding to the pair of translating plates 28 and the support plate 34 of the first embodiment as shown in FIGS. 1 to 7 directly opposes the back surfaces of the pair of the shield plates 22, forming gaps T of predetermined width therebetween without the pair of spacers 31 of the first embodiment being interposed in the gaps T. Absorbing members 29 corresponding to the absorbing members 29 disposed on the bent portions 30 of the translating plates 28 of the first embodiment are disposed on the metal plates 30 projecting from the single translating supporter plate 85 and oppose narrow passages U of the leaking electromagnetic waves which are perpendicular to the gaps T. A pair of circular openings 86 corresponding to the circular openings 33 and 38 of the first embodiment are defined in the translating supporter plate 85. The circular openings 86 have a diameter equal to the width of the elongated openings 25 defined in the shield plates 22. The inner radius L and the inner depth M of the casings 39 forming the second leakage preventing chambers 42 are equal to the corresponding dimentions L and M of the casings 39 of the first embodiment, that is to say, to a quarter of said fundamental wave-length.

The guide rails 35 guiding the rollers 35 in this embodiment are fixed, directly or indirectly, to the side walls of the outer housing 2 of the microwave oven.

A pair of metal terminal boxes 87 fixed to the casings 39 include therein terminals 88 of the upper heater 19 which are capable of engaging with and disengaging from the sockets at the ends of the power supply plates 80 disposed in the terminal rooms Z which include filler members 90 formed of a ceramic or a refractory synthetic resin material which hold tightly between the upper and lower portions thereof said power supply plates 89 formed of metal. Thus, the upper heater 19 is disengageable from the main body 1 of the microwave oven when desired. The lower terminal box 72, having a similar structure to that of the terminal boxes 87, has engaged therein the terminals of the lower heater 20 which is also disengageable from the main body 1 of the microwave oven.

A port 79 defined in the upper wall of the heating box 3 which introduces the electromagnetic waves generated by the magnetron oscillator (not shown) into the heating chamber 4 is hermetically sealed by a cover 91 formed of a refractory synthetic resin having a high transmissibility to high frequency electromagnetic waves.

A metal reflector 92, which may be formed of a single stainless steel plate worked by a press machine, is coated with a black coating layer formed of enamel or refractory paint. A supply port 93, which is cut in the reflector 92 in the horizontal central portion thereof deviating from the portions thereof which are directly above the upper heater 19, is in registry with said port 79 in the vertical direction of the main body 1 of the microwave oven set in the proper position thereof. The reflector 92 is formed in such a way that the portions around the supply port 93 are tilted so that the outer peripheral portions of the reflector 92 are more elevated than the inner peripheral portions thereof surrounding the supply port 93. The reflector 92 having pending portions 94 pending from the outer periphery thereof, is fixed to the upper heater 19 by a plurality of insulators 95 formed of ceramic, and is thus translated vertically with the upper heater 19 by the translation mechanism (not shown).

The electromagnetic waves which tend to escape from the interior of the heating chamber 4 through the elongated openings 18 are effectively and positively mutually cancelled by the choke effect by the first and the second leakage preventing chambers 24 and 42, or absorbed by electromagnetic wave absorbing members 29, in just the same way as in the case of the first embodiment.

The gaps T and the narrow passages v disposed between the shield plates 22 and the translating supporter plate 85, and between the shield plates 22 and the absorbing members 29, respectively, prevent the transfer of heat from the shield plates 22 to the absorbing members 29 and thus prevent the members 29 from being deformed or degraded in quality by said heat. Therefore, the stable electromagnetic wave absorbing faculty of the absorbing members 29 can be kept at a high level over a long period.

Because the terminal boxes 87 connecting the terminals 88 of the upper heater 19 to a power source (not shown) are disposed outside the first and the second leakage preventing chambers 24 and 42, the terminal rooms Z are substantially free from the adverse effects of the high frequency electromagnetic waves leaking from the interior of the heating chamber 4. The back walls of the casings 39 and the walls of the terminal boxes 87 enclosing the terminal rooms Z also prevent the leaking electromagnetic waves from entering into the terminal rooms Z. Therefore, there are no such disadvantages that occur when electric arcing appears across the terminals 88 and the power supply plates 89 due to the high potential difference therebetween caused by the high frequency electromagnetic waves, and that the appliances on the side of the power source are adversely affected by the electric noise transmitted along the line 45 from the terminals 88 of the upper heater 19.

The ceramic or refractory synthetic resin filler materials 90 which fill the interior of the terminal boxes 87 may also be disposed in the interior of the first and the second chambers 24 and 42. These filler materials, when thus disposed, prevent the transfer of heat and vapor generated in the heating chamber 4 during the heating period from entering into the terminal boxes Z, and thus ensures a stable and sure supply of power to the terminals 88 of the upper heater 19, preventing corrosion or a degradation of the insulating capability of the terminals 88 or the components surrounding the terminals 88.

Figure 10:
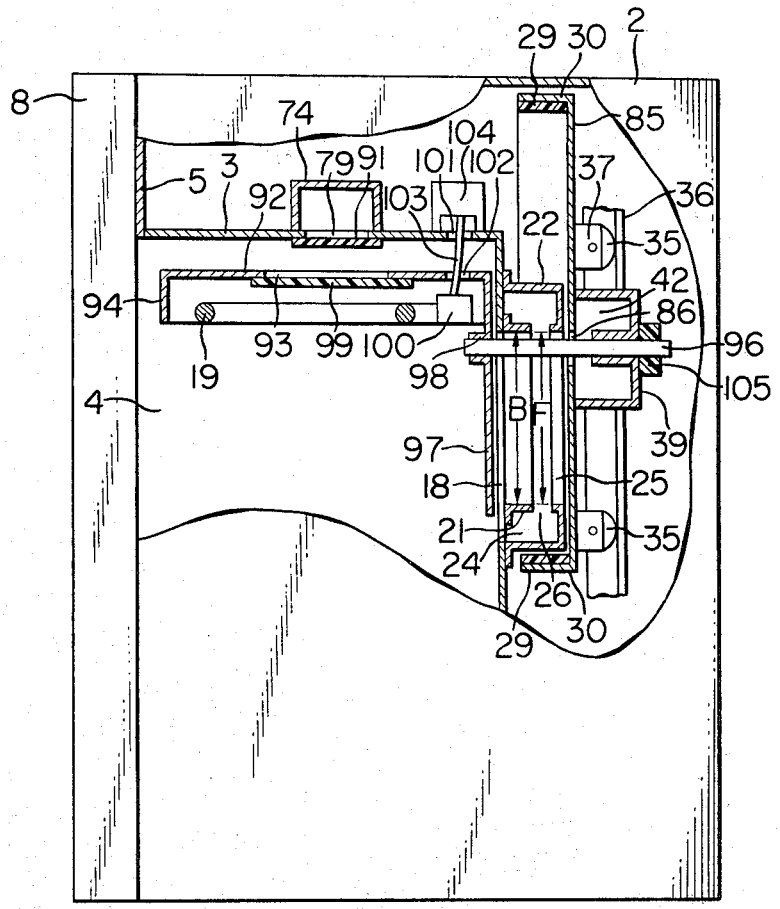
FIG. 10 is a fragmental sectional side view of a third microwave oven according to the present invention, showing a fragmental side cross section thereof.

Referring to FIG. 10, a third embodiment of the present invention is now described.

In this third embodiment, a metal reflector 92 disposed in the heating chamber 4 of the microwave oven is supported by a pair of supporter rods 96 extending from the interior of the heating chamber 4 to the exterior thereof, and is vertically translatable through a translation mechanism (not shown) which is similar to that of the first embodiment. A reflector 92 of this embodiment has a back plate 97 pending from the back side periphery of the horizontal portion of the reflector 92. The back plate 97 is designed to have such dimensions that when the supporter rods 96 are translated to the upper most position thereof, the back plate 97 covers the whole lengths B of the elongated openings 18, forming gaps of a predetermined width therebetween. A pair of holes 98 defined in the back plate 97 engage with the front ends of the supporter rods 96.

A cover plate 99 formed of a refractory material having a high transmissivity to high frequency electromagnetic waves hermetically seals the supply port 93 defined in the central horizontal portion of the reflector 92 in registry with the port 79 defined in the upper wall of the heating box 3. A socket 100 fixed to the reflector 92 connects the terminals of the upper heater 19, which is fixed to the lower surface of the reflector 92, to a power source (not shown). Through an opening 102 defined in the horizontal portion of the reflector 92 and an opening 101 defined in the upper wall of the heating box 3, extends a flexible cord 103 which connects the socket 100 to a cord reel 104 which is disposed outside the heating chamber 4 and automatically winds up the cord 103 which is covered with a flexible shield cover for preventing the transmission of the high frequency electromagnetic waves and is formed of, for example, a metal mesh or gauze.

A pair of annular electromagnetic wave absorbing members 105 surround the back ends of the supporter rods 96. The absorbing members 29 disposed on the metal plates 30 of the translating supporter plate 85 oppose the upper and the lower walls of the shield plates 22 as well as the side walls thereof.

For a detailed description of the structure of the third embodiment in respects other than hereinabove described, refer to the descriptions of the first and second embodiment, which have similar constructions to the third embodiment.

As the third embodiment is constructed as hereinabove described, when the reflector 92 and the upper heater 19 are translated vertically downwards together with the translating supporter plate 85 by the translation mechanism (not shown), the translation thereof meets no obstruction because the flexible cord 103 is automatically led out of the cord reel 104. The reflector 92 reflects the heat developed in and radiated from the upper and lower heaters 19 and 20, and the natural convection due to the hot air is obstructed by the pending portions 94 pending from the horizontal portion of the reflector 92, and thus the heat therefrom is effectively transmitted to the food or the article to be heated.

The leakage of electromagnetic waves through the elongated openings 18 is prevented in a similar way to those of the first or second embodiments. In addition, because the back plate 97 of the reflector 92 covers the portions of the elongated openings 18 which are situated under the upper periphery of the back plate 97, the amount of electromagnetic waves entering into the elongated openings 18 are limited in advance. Furthermore, because the absorbing members 29 surround all the side walls including the upper and lower walls of the shield plates 22, the leakage preventing function of the absorbing members 29 is further ensured and enhanced. The back plate 97 is useful also for preventing contaminations such as drops of oil splashed from the food in the heating chamber 4 from entering into the elongated opening 18.

Figure 11:
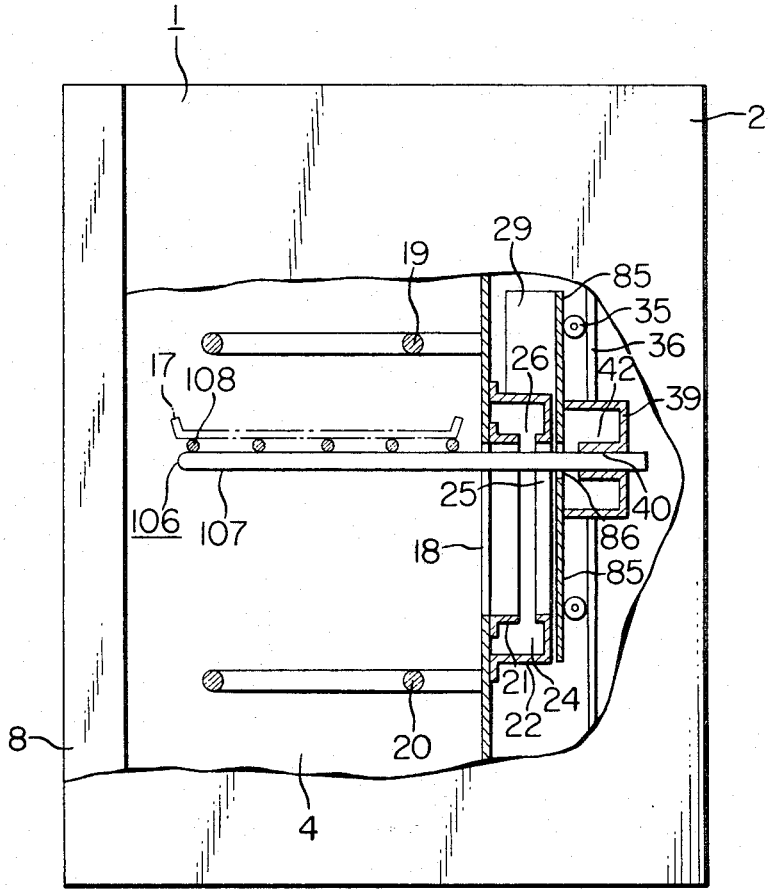
FIG. 11 is a fragmental sectional side view of a fourth microwave oven according to the present invention, showing a fragmental side cross section thereof.

Referring to FIG. 11, a fourth embodiment of the present invention is now described.

In this fourth embodiment, a rack 106 for supporting the supporter 17 for a food container having the form of a rectangular plate is supported by metal U-shaped supporter rod 107 thereof, both end portion of which extend from the interior of the heating room 4 into the exterior thereof. The rack 106 is capable of being vertically translated together with the supporter rod 107 thereof by a translation mechanism (not shown) which is similar to the one disposed in the first embodiment. The rack 106 comprises, besides the supporter rod 107, a plurality of transversal metal rods 108 bridging the pair of arms of the U-shaped supporter rod 107. The upper heater 19 as well as the lower heater 20 of this fourth embodiment is fixed to the heating box 3, and is not capable of being vertically translated. For respects other than hereinabove described, as the structure of the fourth embodiment is similar to that of the first or second embodiment, refer to the descriptions thereof for a more detailed explanation.

By vertically translating the rack 106, the supporter 17 for a food container and therefore the food placed thereon can be placed at any desired position between the upper and the lower heaters 19 and 20, so that finer control of heating intensity becomes possible.

As will be readily understood, because of the heavy load which may be placed on the rack 106, the supporter rod 107 must have dimensions and a structure ensuring sufficient strength to bear such a load.

Figure 12:
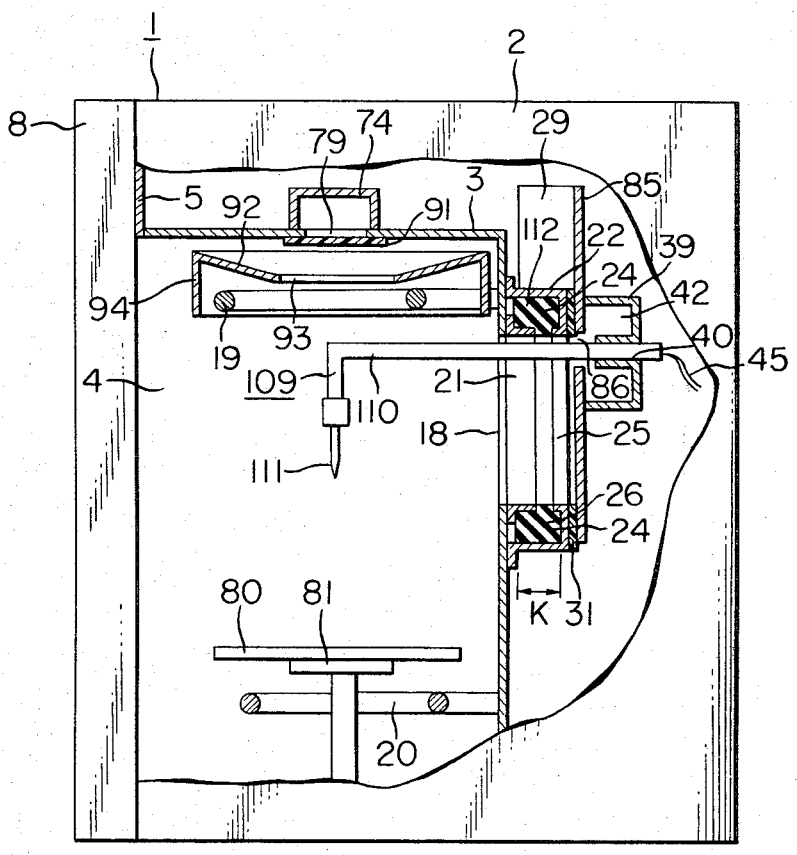
FIG. 12 is a fragmental sectional side view of a fifth microwave oven according to the present invention, showing a fragmental side cross section thereof.

Referring to FIG. 12, of the drawings, a fifth embodiment of the present invention is now described.

In this fifth embodiment, a detector 109 which detects the temperature of the food or the article to be heated and controls the supply of power to the magnetron oscillator (not shown) and/or the heaters 19 and 20 is disposed in the heating chamber 4 and extends from the interior of the heating chamber 4 to the exterior thereof through an elongated opening 18 defined vertically along the central line of the back wall of the heating box 3. The detector 109 which is capable of being vertically translated by a translation mechanism (not shown) similar to the one of the first embodiment comprises a main body 110 formed of a metal tube, and a detector head 111 which is formed at one end of the main body 110 and includes therein an element having resistivity which varies with the change of temperature thereof, for example, a thermistor having a negative temperature to resistance characteristic.

A first leakage preventing chamber 24 includes therein an insulator 112 formed of an insulating material such as a ceramic or a refractory synthetic resin. Because the electromagnetic waves when propagating through such an insulating material have shorter wavelengths than when propagating through air, the depth K of the first chamber 24 is designed to have a smaller value than that of a quarter of the fundamental wavelength of the electromagnetic waves in air, that is to say, it is designed to be substantially equal to a quarter of the fundamental wave-length of the electromagnetic waves propagating in said insulator 112. Other dimensions of the first chamber 24 can be made smaller in proportion.

By the construction of the fifth embodiment as hereinabove described, when the head 111 of the detector 110 is inserted in the food placed on the rotatable table 80, the detector 110 detects the temperature of the food during the heating operation and automatically stops the supply of power to the magnetron oscillator (not shown) and/or the heaters 19 and 20, when the detected temperature reaches a predetermined level. Thus, by presetting said predetermined temperature to a desired level to suit the cooking of the food, over-heating of the food can be avoided. In addition, the heating operation can be effectively carried out without any danger of the operator being burned while translating the detector 109, because the translation of the detector 109 can be effected from outside by the translation mechanism (not shown).

The detector 109 for detecting the temperature of the food of this fifth embodiment may, of course, be replaced by a detector which detects conditions other than the temperature of the food, such as the humidity thereof.

Furthermore, since the amount of electromagnetic waves leaking along the detector 109 is negligible, the control signals are free from noise due to leaking electromagnetic waves, and thus, stable control is ensured.

Figure 13:
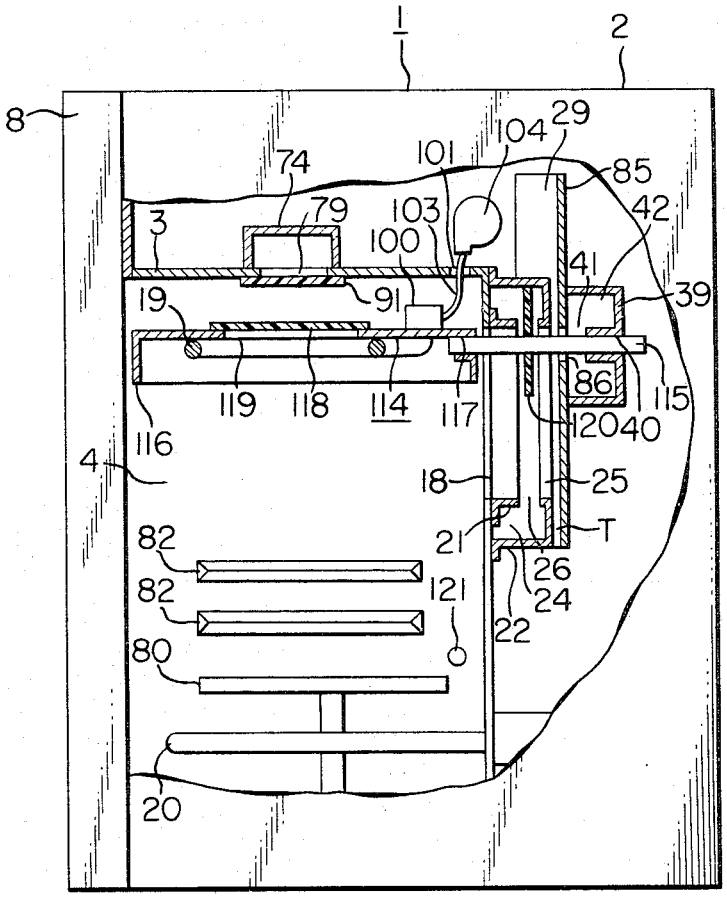
FIG. 13 is a fragmental sectional side view of a sixth microwave oven according to the present invention, showing a fragmental side cross section thereof.

Referring now to FIG. 13 of the drawings, a sixth embodiment of the present invention is described.

In the sixth embodiment, a partition plate 114 which partitions the heating chamber 4 into two spaces situated thereabove and thereunder and which has fixed on the lower surface thereof an upper heater 19, is supported by a pair of supporter rods 115 thereof which extend from the interior of the heating chamber 4 into the exterior thereof through a pair of elongated openings 18 and are capable of being vertically translated by a translation mechanism (not shown). The partition plate 114 is formed of a metal plate and comprises a flat horizontal portion which substantially traverses the whole horizontal cross section of the heating chamber 4, and has pending portions 116 pending from the outer peripheries of the horizontal portion of the partition plate 114. The front ends of the supporter rods 115 engage with holes 117 defined in one of the pending portions 116.

A supply port 119 for the electromagnetic waves radiated from the port 79 is defined in the central portion of the flat horizontal portion of the partition plate 114 in registry with the port 79 defined in the upper wall of the heating box 3, and is hermetically sealed by a cover 118 formed of a refractory material having a high transmissivity to high frequency electromagnetic waves. The supporter rods 115 have fixed thereon substantially at the middle portions thereof electromagnetic wave absorbing members 120 in the form of annuli. A steam port 121 is defined in one of the side walls of the heating box for the purpose of introducing steam generated outside the heating chamber 4, which is useful in the cooking of some foods.

The elements 100 to 104 are substantially the same as the corresponding elements 100 to 104 of the third embodiment described in conjunction with FIG. 10.

By the structure of the sixth embodiment as hereinabove described, by setting the partition plate 114 and the upper heating 19 at a desired height and by energizing the upper and the lower heaters 19 and 20, the space under the partition plate 114 of the heating chamber 4 containing the food can be raised to high temperature in a short time which is necessary for some particular cooking purposes.

Furthermore, by introducing steam into the heating chamber 4 through the port 121, steaming of the food can also be effected.

Thus, the time needed for the cooking of food by the heaters 19 and 20, and by the steam introduced from the port 121 can be substantially shortened. Since the electromagnetic waves from the port 79 can be radiated through the port 119 into the space under the partition plate 114 irrespective of the position of the partition plate 114, the food or the article to be heated can be quickly heated from within. Thus, the quick, uniform, and effective heating and cooking of food can be effected with the help of the heaters 19 and 20 and the steam introduced from the port 121 into the heating chamber 4.

Figure 14:
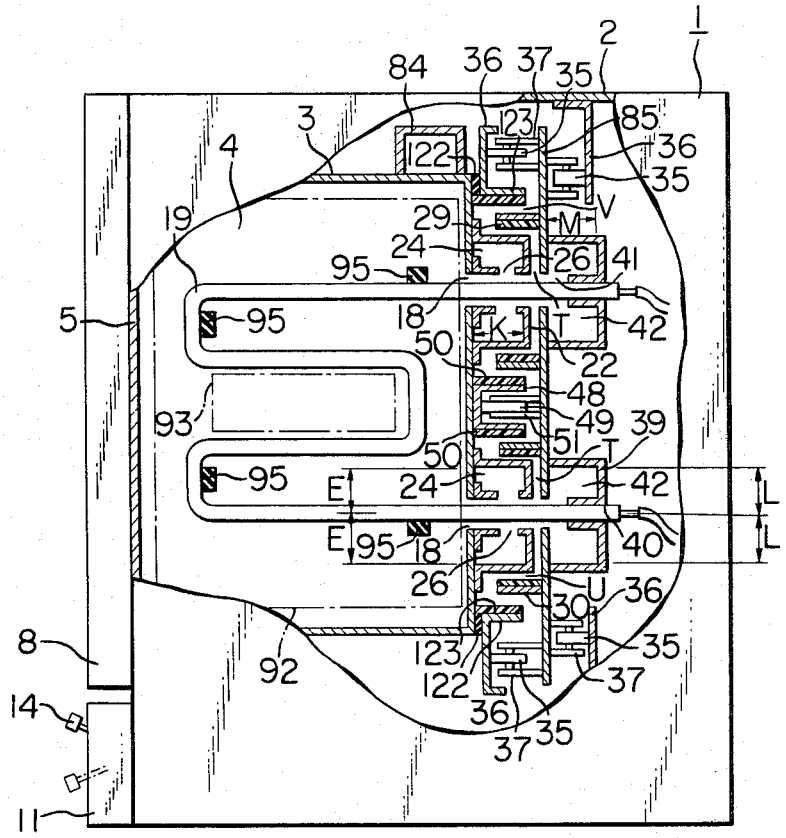
FIG. 14 is a fragmental sectional top view of seventh microwave oven according to the present invention, showing a fragmental horizontal cross section thereof.

Referring to FIG. 14 of the drawings, a seventh embodiment of the present invention is now described.

As in the case of the first and the second embodiments, an upper heater 19 disposed in the heating chamber 4 and extending therefrom into the exterior thereof is capable of being vertically translated by a translation mechanism (not shown). In this seventh embodiment, additional pairs of rollers 35 are mounted on both sides of the translating supporter plate 85 on the front surface thereof through roller holders 37, and are guided by the guide rails 36 attached to the back surface of the back wall of the heating box 3 with a plate 122 formed of a refractory material having low heat conductance interposed therebetween. At the center of the translating supporter plate 85 there is also disposed a roller 49 held by roller holders 51 and guided by a metal plate 48 which is fixed to the back wall of the heating box 3 and which has fixed thereon a pair of absorbing members 50. Absorbing members 123 disposed on the guide rails 36 fixed on the back wall of the heating box 3 oppose the whole length of the side walls of the shield plates 22 and form gaps V with the metal plates 30.

Since the electromagnetic waves escaping from the leakage preventing chambers 24 are absorbed in two stages by the absorbing members 29 and 123 disposed along the direction of leakage of the electromagnetic waves, the amount of the leaking electromagnetic waves can be reduced to a much smaller magnitude. In addition, since the absorbing members 123 are disposed on the guide rails 36, the structure is relatively simple.

The first seven embodiments of the present invention as hereinabove described in which the first electromagnetic leakage preventing chambers 24 are stationary with respect to the heating box 3, can be subjected to modifications without deviating from the principles of the present invention. For example, insted of extending the end portions of the upper heater 19 from the interior of the heating chamber 4 into the exterior thereof, as was the case in the first or the second embodiment, it is possible to extend the lines 45 connecting the terminals of the upper heater 19 to the power source (not shown), from the interior of the heating room into the exterior thereof, without impairing the leakage preventing faculty of these embodiments. This is also true of the line 45 of the fifth embodiment.

The following is a description of four further emboidiments of the present invention in which the first leakage preventing chambers are capable of being vertically translated together with a vertically translatable member extending from the interior of the heating chamber to the exterior thereof.

Figure 15:
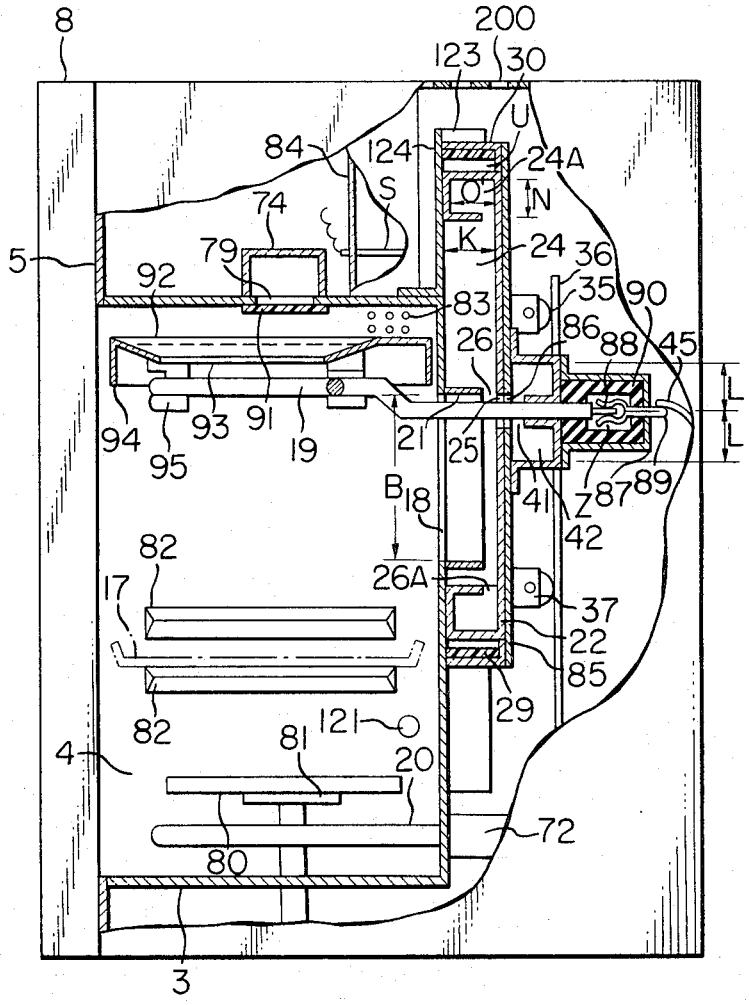
FIG. 15 is a fragmental sectional side view of an eighth microwave oven according to the present invention, showing a fragmental side cross section thereof.
Figure 16:
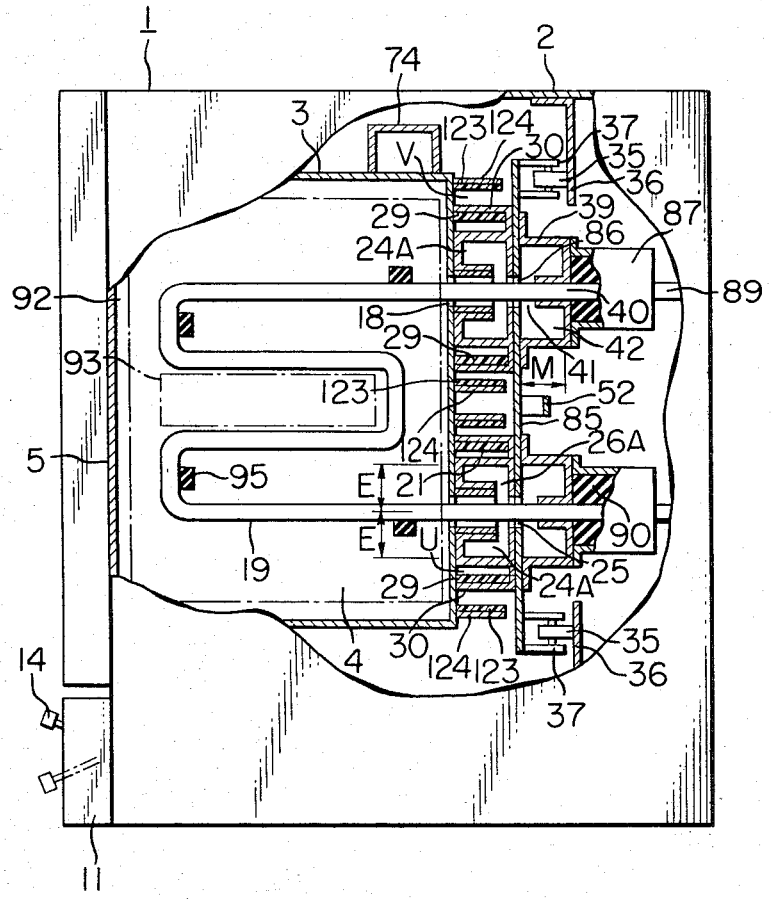
FIG. 16 is a fragmental sectional top view of the microwave oven of FIG. 15, showing a fragmental horizontal cross section thereof.

Referring to FIGS. 15 and 16 of the drawings, an eighth embodiment of the present invention is illustrated, wherein an upper heater 19 extending from the interior of the heating chamber 4 to the exterior thereof is capable of being vertically translated.

Two shield plates 22, which are fixed to the translating supporter plate 85, are in contact with the back surface of the back wall of the heating box 3 around the elongated openings 18, and are capable of being vertically translated. A pair of first leakage preventing chambers 24 formed between the back wall of the heating box 3 and the shield plates 22 have communication ports 26, and have a widthwise depth E measured from the centers of the chambers 24 which is substantially equal to a quarter of the fundamental wave length of the electromagnetic waves utilized, and a depth K which is longer than a quarter of the fundamental wavelength by a small amount. The bent portions of the shield plates 22 at the peripheries thereof form a pair of choke chambers 24A having the form of annuli in the first leakage preventing chamber 24. The choke chambers 24A have communication ports 26A, and have a height N and a depth O which are substantially equal to a quarter of the fundamental wavelength. The translating supporter plate 85 is capable of being vertically translated by a translation mechanism (not shown) with the rollers 35 guided along the guide rails 36.

A pair of metal plates 30, fixed around the whole lengths of the outer peripheral surfaces of the shield plates 22, is in contact with the back wall of the heating box 3 and metal partition plates 124 fixed to the heating box 3. The metal plates 30 have fixed thereon electromagnetic wave absorbing members 29 which oppose the whole peripheral surfaces of the shield plates 22 with gaps U having a depth substantially equal to a quarter of the fundamental wavelength formed therebetween. The partition plates 124 fixed to the upper and the back wall of the heating box 3 have U-shaped horizontal cross sections above the heating box 3, with two arms of a V-shape extending in the backward direction, of the main body 1 of the microwave oven, and the lower portions of the partition plate 124 form two plate portions opposing each other. The partition plates 124 are designed to have such dimensions that the side walls of the shield plates 22 are always covered therewith during the vertical translation of the shield plates 22. Electromagnetic wave absorbing members 123 fixed to the partition plates 124 along the entire lengths thereof that oppose the metal plates 30 form gaps V with the metal plates 30. Circular openings 25 and 86 are defined in the shield plates 22 and the translating supporter plate 85 respectively.

Since the eighth embodiment is constructed as hereinabove described, most of the electromagnetic waves leaking from the heating chamber 4 through the elongated openings 18 are introduced into the choke chamber 24A and mutually cancelled therein by the choke effect. And because the shield plates 22 are in contact with the back surface of the back wall the heating chamber 4 and the backward facing surfaces of partition plates 21 around the elongated ports 18 on the whole surface areas thereof, the electromagnetic waves can barely pass between the contacting surfaces. The limited amount of electromagnetic waves passing between the shield plates 22 and the back surface of the back wall of the heating box 3 and between the shield plates 22 and the backward facing surfaces of the partition plates 21 are absorbed by the absorbing member 29 or are mutually cancelled by the choke effect in the gaps U. Furthermore, the absorbing members 123 absorb the electromagnetic waves which escape from the gaps U, thereby realizing the almost complete prevention of the leakage of electromagnetic waves.

Since the upper heater 19 is designed to be capable of disengagement from the terminal boxes 87, the circular openings 25 and 86, defined in the shield plates 22 and the translating supporter plate 85 respectively, have a diameter larger than the outer diameter of the upper heater 19. But the electromagnetic waves leaking through the circular openings 25 and 86 are extinguished by the leakage preventing chambers 42. When the upper heater 19 is designed to be incapable of disengagement from the main body 1 of the microwave oven, the circular openings 25 and 86 can be made to have smaller diameters and to tightly fit with the upper heater 19. In this case, the second leakage preventing chambers 42 can be omitted without incurring the danger of leakage through the circular openings 25 and 86. This is also true of the cases where other members such as detectors are used instead of the upper heater 19.

Figure 17:
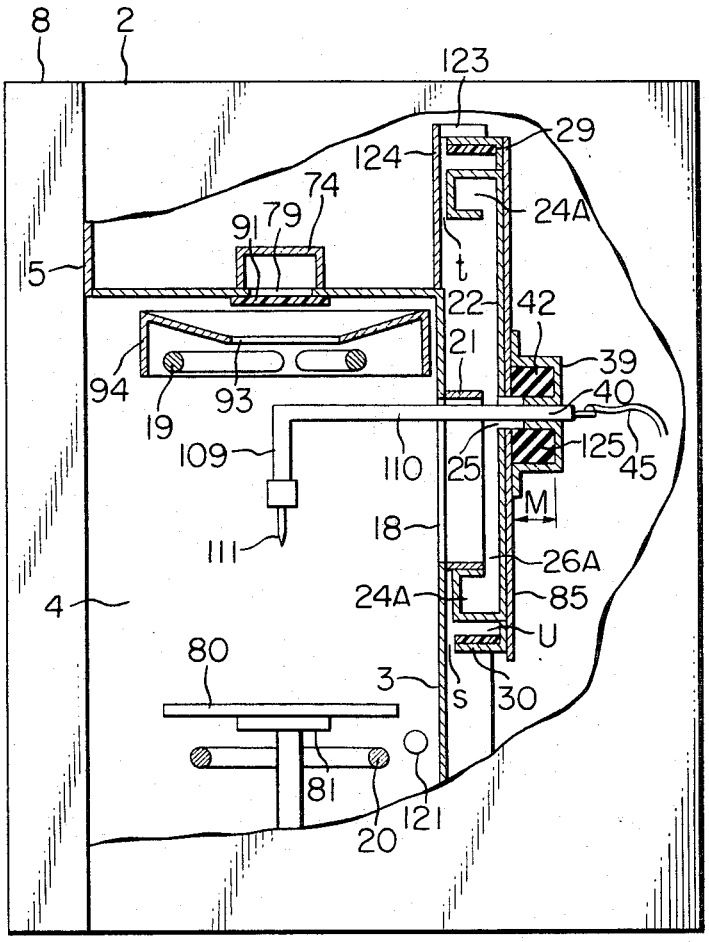
FIG. 17 is a fragmental sectional side view of a ninth microwave oven according to the present invention, showing a fragmental side cross section thereof.

Referring now to FIG. 17 of the drawings, a ninth embodiment of the present invention is illustrated, wherein a detector 109 is vertically translatable.

The detector 109 disposed in the heating chamber 4 is similar to the detector 109 of the fifth embodiment. An insulator member 125 disposed in the casing 39 and formed of a material such as a ceramic or a refractory synthetic resin prevents steam generated in the heating chamber 4 from entering into the second leakage preventing chamber 42 through the elongaged opening 18.

Gaps t are formed between the shield plate 22 and the back wall of the heating box 3 and between the backward facing surface of the shield plate 22 and the partition plate 124. Gaps s are also formed between the metal plate 30 and the back wall of the heating box 3 and between the metal plate 30 and the backward facing surface of the partition plate 124.

In respects other than hereinabove described, the ninth embodiment is similar in construction to the eighth embodiment.

Since the ninth embodiment is constructed as hereinabove described, the detector can be vertically translated without meeting any frictional force due to contacts between the shield plate 22 and the metal plate 30 with the back wall of the heating box 3 and the partition plate 124. Therefore, the translating supporter plate 85 can be translated easily without exertion by an operator.

Because of the disposition of the choke room 24A and the gaps v similar to the choke chambers 24A and the gaps v of the eighth embodiment, the amount of the electromagnetic waves leaking through the gaps t and s is quite limited and substantially negligible.

Figure 18:
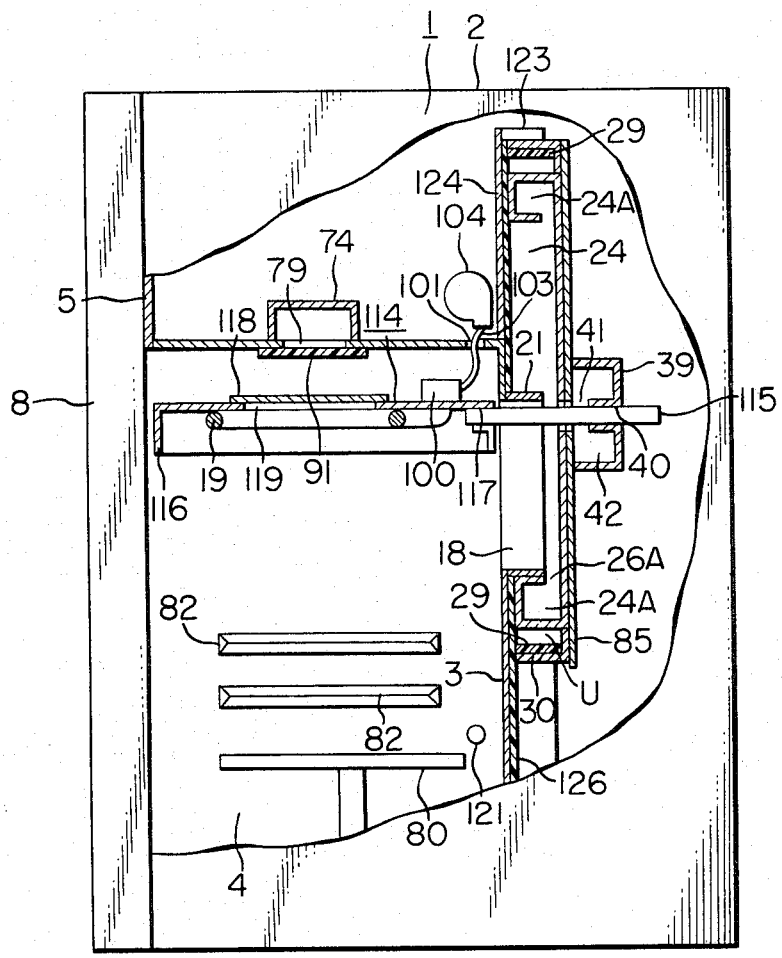
FIG. 18 is a fragmental sectional side view of a tenth microwave oven according to the present invention, showing a fragmental side cross section thereof.
Figure 19:
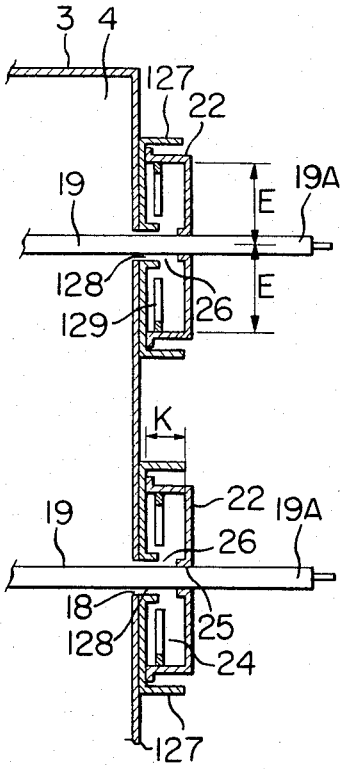
FIG. 19 is a fragmental sectional top view of an eleventh microwave oven according to the present invention, showing a fragmental horizontal cross section of a portion at the backside of the heating chamber thereof including the leakage preventing chambers.
Figure 20:
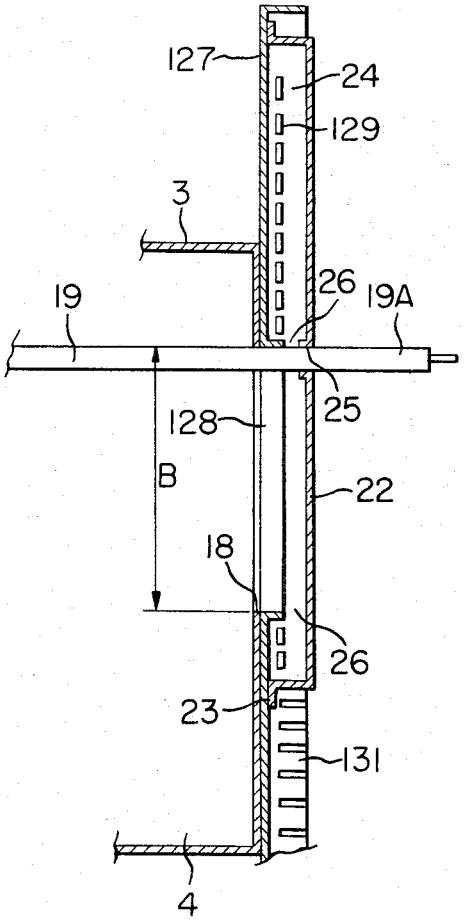
FIG. 20 is a fragmental sectional side view of the microwave oven of FIG. 19, showing a fragmental side cross section of a portion at the backside of the heating chamber thereof including the leakage preventing chambers.
Figure 21:
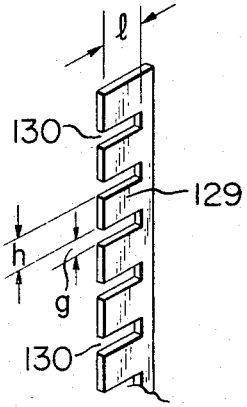
FIG. 21 is a perspective view of one of the attenuator plates disposed in the leakage preventing chambers of the microwave oven of FIG. 19.
Figure 22:
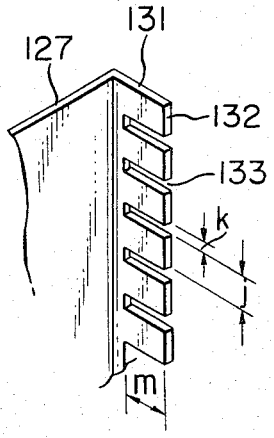
FIG. 22 is a perspective view of one of the attenuator plates formed by the bent portions of the partition plates fixed to the back wall of the heating box of the microwave oven of FIG. 10.

Referring now to FIG. 18 of the drawings, a tenth embodiment of the present invention is illustrated wherein a partition plate 114 similar to that of the sixth embodiment is vertically translatable.

A continuous thin coating 126 of about from 30 to 100 microns of a refractory material having a low heat conductance and a low coefficient of friction, such as polytetrafluoroethylene, is coated on the back wall of the heating box 3 and the partition plate 124 in order to prevent direct contact between the shield plates 22 and the metal plate 30 with the heating box 3 and the partition plate 124. In respects other than hereinabove described, the structure of this embodiment is similar to those of the last two embodiments.

The leakage of the electromagnetic waves in this embodiment is prevented in the same way as in the last two embodiments. The tenth embodiment has the advantage that the translation of the shield plates 22 with the translating supporter plate 85 is made easy by the disposition of the coating 126, which also results in the advantage that the transfer of heat from the back wall of the heating box 3 to the shield pleates 22 and the absorbing members 29 can be effectively prevented and thus the shield plates 22 and the absorbing members 29 are free from the danger of being overheated.

The last three embodiments which have vertically translatable first leakage preventing chambers 24 can also be subjected to many modifications.

For example, the coating 126 of the tenth embodiment may be an anodized insulator protective oxide film which is formed, for example, on an aluminium plate. Although the choke chambers 24A are formed within the first leakage preventing chambers 24, it will be easily understood from the above descriptions that this formation of the choke chambers 24A within the leakage preventing chambers 24 is not always necessary.

Although the first seven embodiments whose first leakage preventing chambers 24 are stationary with respect to the heating box of the microwave oven are somewhat better in leakage preventing faculty and can be constructed samewhat smaller than the latter three embodiments, all the embodiments are equally effective in operation. Therefore, it is possible to combine the features of the two groups of embodiments. For example, the leakage preventing chambers 24 of the eighth embodiment may include therein further leakage preventing chambers which are similar in construction to the leakage preventing chambers 24 of the first or second embodiments, thereby further increasing the leakage preventing faculty thereof.

Referring now to FIGS. 19 to 22, the eleventh embodiment of the present invention is described.

As the eleventh embodiment is constructed in a similar way to the above described embodiments except for the structures of the portions including the first leakage preventing chambers 24, only the different structures thereof are described.

A pair of elongated openings 18 are defined in the back wall of the heating box 3 in parallel in the vertical direction. The length B of the openings 18 is equal to three times a quarter of the fundamental wave-length of the electromagnetic waves utilized in the microwave oven.

The upper heater 19 has the end portions or terminal portions 19A extending through the elongated openings 18 and is vertically translatable along the elongated openings 18. A pair of metal partition plates 127 is fixed on the back wall of the heating box 3 around the elongated openings 18. A pair of shield plates 22 in the form of casings with open front surfaces, which may be formed integrally by a press machine, cover the back side of the back wall of the heating box 3 around the elongated openings 18.

The shield plates 22 have defined in the central portions thereof circular openings 25 tightly fitted with the end portion 19A of the upper heater 19, and thus are vertically translated with the upper heater 19, the flanges 23 thereof being in contact with the partition plates 127. The shield plates 22 have such dimensions that the back wall of the heating box 3 situated around the elongated openings 18 are always covered by the shield plates 22 during the vertical translation thereof. Elongated openings 128 having dimensions corresponding to those of the elongated openings 18 are defined in the partition plates 127. Leakage preventing chambers 24 formed between the partition plates 127 and the shield plates 22 have a widthwise depth E measured from the centers of the leakage preventing chambers 24 substantially equal to a quarter of the fundamental wavelength, and a depth K substantially equal to one eighth of the fundamental wave-length.

Communication ports 26 of the leakage preventing chambers 24 are defined between the partition plates 127 and the shield plate 22. Metal attenuator plates 129 disposed in the leakage preventing chambers 24 have defined therein a plurality of slits 130 of width g which are spaced from each other by a predetermined distance h. The length l of the slits 130 is equal to from 20 to 30 mm.

The bent portions 131 formed around the whole lengths of the peripheries of the partition plates 127 form attenuator plates 131 having defined therein a plurality of slits 133 which have width k and are spaced from each other by a distance j. The length m of the slits 133 is made equal to from 10 to 15 mm, and the width k and the distance j are substantially equal to the corresponding dimensions g and h of the attenuator plates 129.

Since the eleventh embodiment of the present invention is constructed as described above, the electromagnetic waves which tend to leak from the interior of the heating chamber 4 through the elongated openings 18 during the high frequency heating operation are substantially extinguished in the leakage preventing chambers 24 by the choke effect. Namely, the electromagnetic waves entering into the leakage preventing chambers 24 and propagating in the widthwise direction of the leakage preventing chambers 24 are mutually cancelled by the choke effect because the widthwise depth E is substantially equal to a quarter of the fundamental wave length.

Although the electromagnetic waves propagating in the widthwise direction of the leakage preventing chambers 24 are extinguished by said choke effect in the leakage preventing chambers 24, the electromagnetic waves entering into the leakage preventing chambers 24 also have the component propagating in the vertical direction of the leakage preventing chambers 24. Thus, it was found preferable that the vertical component of the electromagnetic waves entering into the leakage preventing chambers 24 also be extinguished or attenuated by some means other than the leakage preventing chambers 24 themselves.

In this embodiment, therefore, attenuator plates 129 which attenuate the component of the electromagnetic waves propagating across the slits 130, that is to say, the component propagating in the vertical direction of the leakage preventing chambers 24, are disposed in the leakage preventing chambers 24. Thus, both horizontal and vertical components of the electromagnetic waves entering into the leakage preventing chambers 24 are mutually cancelled or attenuated.

Furthermore, the electromagnetic waves which are not sufficiently attenuated in the leakage preventing chambers 24 and leak therefrom through the contacts between the partition plates 127 and the shield plate 22 are attenuated by the attenuator plates 131 due to the function thereof corresponding to that of the attenuator plates 129. Thus, the leakage of the electromagnetic waves through the contact between the partition plates 127 and the shield plates 22 is effectively prevented.

The attenuator plates 129 and 131 in the above embodiment which are described as being formed of metal plates having defined therein a plurality of slits, may also be formed of synthetic resin plate having coated thereon an electrically conductive layer having the form of the teeth of a comb, or of metal plates bent into corrugated plates.

In all the eleven embodiments described above, the vertical translation was effected manually by an operator through the translation mechanism. But it is also possible to use a prime mover such as an electric motor for the vertical translation, thereby simplifying the operation of the translation.

Because according to the present invention the electromagnetic waves leaking from the interior of the heating chamber 4 through the elongated openings 18 are for the most part mutually cancelled by the choke effect, the durability of the device is increased and the vertical translation of the member extending from the interior of the heating chamber 4 into the exterior thereof can be effected smoothly, as compared to the cases where the elongated openings 18 are electromagnetically sealed by resilient plate members which are set in contact with said extending members.

What is claimed is:

1. A high frequency heating apparatus, comprising:

an enclosure defining therein a heating chamber for accommodating therein an article to be heated and having an elongated opening extending therethrough;

electromagnetic wave supply means for supplying electromagnetic waves of a substantially predetermined wave length into said heating chamber for dielectric heating of said article;

a member movably extending through said elongated opening from interior to said heating chamber to exterior to said heating chamber;

means for supporting and guiding said member with respect to said enclosure for a guided translational movement within and along said elongated opening in the enclosure;

means for moving said guided member within said elongated opening and holding the member at at least two positions; and electromagnetic wave leakage preventing means for preventing an electromagnetic wave leakage from said heating chamber through said elongated opening, including means for defining a substantially elongated first annular space defined by an electrically conductive material and disposed along a periphery of said elongated opening, said first annular space having a circumferentially extending communication port at the inner periphery thereof for introducing therethrough the electromagnetic waves passing through said elongated opening into said first annular space, said first annular space being dimensioned to be effective for extinguishing, by means of the choked effect, the electromagnetic waves introduced therein;

whereby said member is translatable within said heating chamber while the leakage of the electromagnetic waves through said elongated opening is substantially prevented;

wherein said electromagnetic wave leakage preventing means comprises a plate member attached to said supporting means and movable with respect to said enclosure for substantially closing said elongated opening in the enclosure and the inner space defined by the inner periphery of said elongated first annular space, said plate member being dimensioned to substantially close said elongated opening and said inner space irrespective of the position of said supporting means;

and wherein said elongated opening has a longitudinal length substantially equal to an odd multiple of a quarter of a fundamental wave length of said electromagnetic waves, and said communication port of said first annular space is substantially hermetically sealed by a cover member which is formed of a refractory material which is transparent to said electromagnetic waves.

2. A high frequency heating apparatus as claimed in claim 1, wherein said cover member has a pair of parallel spaced elongated projections extending in the lengthwise direction of said elongated opening, said parallel projections being composed of a low friction material and dimensioned to guide said member in said space between the projections.

3. A high frequency heating apparatus, comprising:

an enclosure defining therein a heating chamber for accommodating therein an article to be heated and having an elongated opening extending therethrough;

electromagnetic wave supply means for supplying electromagnetic waves of a substantially predetermined wave length into said heating chamber for dielectric heating of said article;

a member movably extending through said elongated opening from interior to said heating chamber to exterior to said heating chamber;

means for supporting and guiding said member with respect to said enclosure for a guided translational movement within and along said elongated opening in the enclosure;

means for moving said guided member within said elongated opening and holding the member at at least two positions; and electromagnetic wave leakage preventing means for preventing an electromagnetic wave leakage from said heating chamber through said elongated opening, including means for defining a substantially elongated first annular space defined by an electrically conductive material and disposed along a periphery of said elongated opening, said first annular space having a circumferentially extending communication port at the inner periphery thereof for introducing therethrough the electromagnetic waves passing through said elongated opening into said first annular space, said first annular space being dimensioned to be effective for extinguishing, by means of the choke effect, the electromagnetic waves introduced therein;

whereby said member is translatable within said heating chamber while the leakage of the electromagnetic waves through said elongated opening is substantially prevented;

wherein said electromagnetic wave leakage preventing means comprises a plate member attached to said supporting means and movable with respect to said enclosure for substantially closing said elongated opening in the enclosure and the inner space defined by the inner periphery of said elongated first annular space, said plate member being dimensioned to substantially close said elongated opening and said inner space irrespective of the position of said supporting means;

and wherein an electromagnetic wave absorbing material for absorbing and dissipating electromagnetic wave energy is disposed in an electromagnetic wave leakage path between said movable plate member and said elongated first annular space;

and wherein said leakage preventing means comprises a second substantially annular space defined by an electrically conductive material and disposed on and about said extending member, said second annular space having a circumferentially extending communication port at the inner periphery thereof for introducing therethrough the electromagnetic waves passing through said inner space of said first annular space into said second annular space, said second annular space being dimensioned to be effective for extinguishing, by means of the choke effect, the electromagnetic waves introduced therein.

4. A high frequency heating apparatus as claimed in claim 3, wherein said defining means comprises a portion of said enclosure around said elongated opening and said movable plate member covering said elongated opening and having a substantially annular flange portion extending from a major flat surface of said plate member toward said enclosure, said elongated annular space being defined between said enclosure and said plated member.

5. A high frequency heating apparatus as claimed in claim 4, wherein said elongated opening in the enclosure has at its periphery a substantially annular flange integrally extending therefrom toward said major flat portion of the plate member by a predetermined distance to form said communication port between said flange and said plate member.

6. A high frequency heating apparatus, comprising:

an enclosure defining therein a heating chamber for accommodating therein an article to be heatedd and having an elongated opening extending therethrough;

electromagnetic wave supply means for supplying electromagnetic waves of a substantially predetermined wave length into said heating chamber for dielectric heating of said article;

a member movably extending through said elongated opening from interior to said heating chamber to exterior to said heating chamber;

means for supporting and guiding said member with respect to said enclosure for a guided translational movement within and along said elongated opening in the enclosure;

means for moving said guided member within said elongated opening and holding the member at at least two positions; and electromagnetic wave leakage preventing means for preventing an electromagnetic wave leakage from said heating chamber through said elongated opening, including means for defining a substantially elongated first annular space defined by an electrically conductive material and disposed along a periphery of said elongated opening, said first annular space having a circumferentially extending communication port at the inner periphery thereof for introducing therethrough the electromagnetic waves passing through said elongated opening into said first annular space, said first annular space being dimensioned to be effective for extinguishing, by means of the choke effect, the electromagnetic waves introduced therein;

whereby said member is translatable within said heating chamber while the leakage of the electromagnetic waves through said elongated opening is substantially prevented;

wherein said electromagnetic wave leakage preventing means comprises a plate member attached to said supporting means and movable with respect to said enclosure for substantially closing said elongated opening in the enclosure and the inner space defined by the inner periphery of said elongated first annular space, said plate member being dimensioned to substantially close said elongated opening and said inner space irrespective of the position of said supporting means;

and wherein an electromagnetic wave absorbing material for absorbing and dissipating electromagentic wave energy is disposed in an electromagnetic wave leakage path between said movable plate member and said elongated first annular space;

and wherein said defining means comprises a portion of said enclosure around said elongated opening and said movable plate member covering said elongated opening and having a substantially annular flange portion extending from a major flat surface of said plate member toward said enclosure, said elongated first annular space being defined between said enclosure and said plate member.

7. A high frequency heating apparatus as claimed in claim 6, wherein said elongated opening in the enclosure has at its periphery a substantially annular flange integrally extending therefrom toward said major flat portion of the plate member by a predetermined distance to form said communication port between said flange and said plate member.

8. A high frequency heating apparatus as claimed in claim 7, wherein said flange portion of the plate member includes a bent extension defining therein a substantially annular cavity with a circumferential communication port for extinguishing the electromagnetic waves by means of the choke effect.

9. A high frequency heating apparatus as claimed in claim 8, wherein said movable plate member includes a second substantially elongated annular flange having an electromagnetic wave absorbing material attached on its inner surface.

* * * * *